US009084709B2

(12) United States Patent
Karlsson et al.

(10) Patent No.: US 9,084,709 B2
(45) Date of Patent: Jul. 21, 2015

(54) SLING BAR FOR PATIENT LIFT SLINGS

(71) Applicant: Liko Research & Development AB, Lulea (SE)

(72) Inventors: Roger Karlsson, Rosvik (SE); Ronnie Arespong, Lulea (SE)

(73) Assignee: Liko Research & Development AB, Lulea (SE)

( * ) Notice: Subject to any disclaimer, the term of this patent is extended or adjusted under 35 U.S.C. 154(b) by 0 days.

(21) Appl. No.: 14/205,572

(22) Filed: Mar. 12, 2014

(65) Prior Publication Data

US 2014/0265391 A1 Sep. 18, 2014

Related U.S. Application Data

(60) Provisional application No. 61/783,067, filed on Mar. 14, 2013.

(51) Int. Cl.

| | |
|---|---|
| ***B66C 1/00*** | (2006.01) |
| ***A61G 7/10*** | (2006.01) |
| ***B66C 1/12*** | (2006.01) |

(52) U.S. Cl.

CPC ..... *A61G 7/1073* (2013.01); *A61G 7/1061* (2013.01); *A61G 7/1069* (2013.01); *B66C 1/12* (2013.01); *A61G 7/1015* (2013.01); *A61G 7/1044* (2013.01); *A61G 7/1051* (2013.01); *A61G 2203/78* (2013.01)

(58) Field of Classification Search

CPC . A61G 7/1073; A61G 7/1015; A61G 7/1051; A61G 7/1061; A61G 7/1069; B66C 1/12; B66C 1/00

USPC ..... 294/81.1, 81.3, 81.56, 67.1, 67.3, 294/67.31, 68.1, 68.2, 68.21, 68.3, 74, 75, 294/82.1, 82.11, 81.55; 5/83.1, 81.1 R, 84.1, 5/87.1, 89.1; 254/329, 334, 380

See application file for complete search history.

(56) References Cited

U.S. PATENT DOCUMENTS

| | | | | |
|---|---|---|---|---|
| 6,279,208 | B1 | 8/2001 | Gillis | |
| 6,662,409 | B2 | 12/2003 | Benecke | |
| 7,284,745 | B2 * | 10/2007 | Keane et al. | 254/372 |
| 7,341,506 | B1 * | 3/2008 | Hogue | 452/189 |
| 7,434,787 | B2 * | 10/2008 | Hjort | 254/329 |

(Continued)

FOREIGN PATENT DOCUMENTS

WO WO-2013034936 A1 3/2013

OTHER PUBLICATIONS

Jun. 12, 2014 European Search Report for European Patent Application 14160116.1.

*Primary Examiner* — Stephen Vu
(74) *Attorney, Agent, or Firm* — Schiff Hardin LLP

(57) ABSTRACT

Disclosed is a new sling bar for use with an overhead lift system to lift a load suspended in a lift sling there below. The sling bar comprises a cross bar having first and second ends, a pair of lift loop retention ears extending from each of the first and second ends of the cross bar. Each pair of ears includes a first ear in the pair being disposed adjacent a first face of the cross bar and a second ear in the pair disposed adjacent a second opposite face of said cross bar, the pair of retention ears defining a space there between. A lift hook is disposed at each of the first and second ends of the cross bar in the space defined between the pair of retention ears, the pair of ears extending at least up to an inner surface of a bend portion of the lift hook.

25 Claims, 20 Drawing Sheets

(56) References Cited

U.S. PATENT DOCUMENTS

| | | | | |
|---|---|---|---|---|
| 7,654,593 | B2 | 2/2010 | Hjort | |
| 7,896,416 | B2 * | 3/2011 | Carter | 294/167 |
| 8,100,449 | B2 | 1/2012 | Wray | |
| 2009/0307840 | A1 | 12/2009 | Lingegard | |
| 2011/0108784 | A1 | 5/2011 | Bogh-Sorensen | |

* cited by examiner

FIG. 18
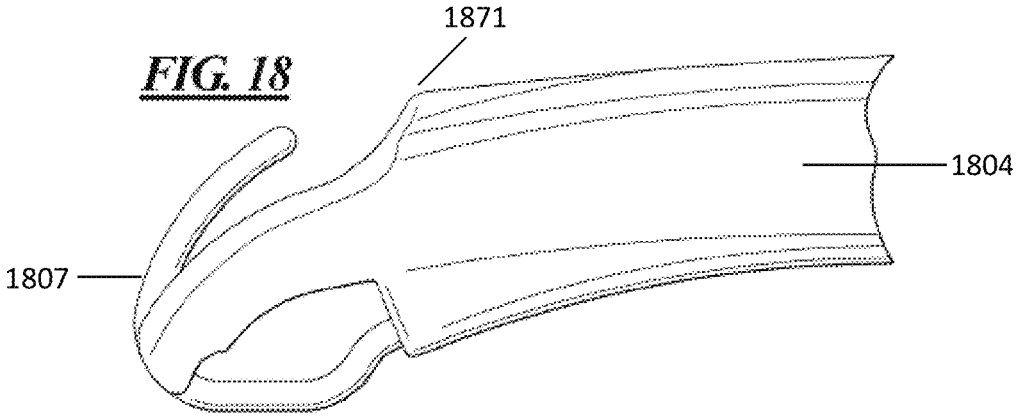
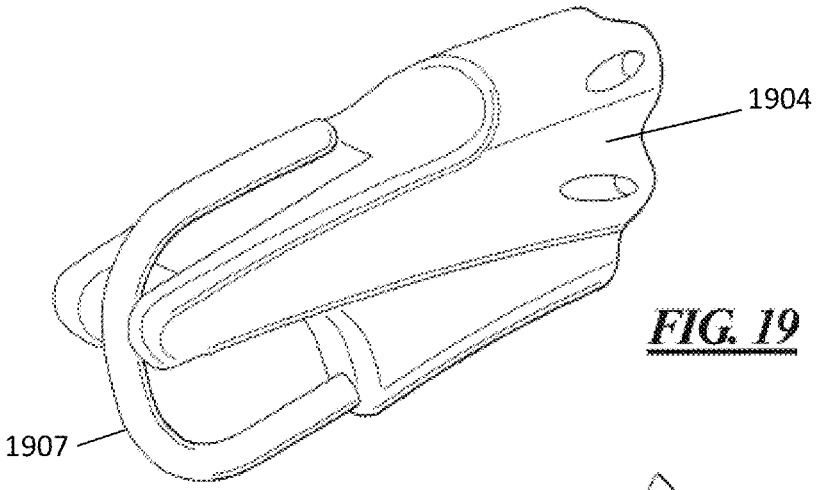
FIG. 19
FIG. 20
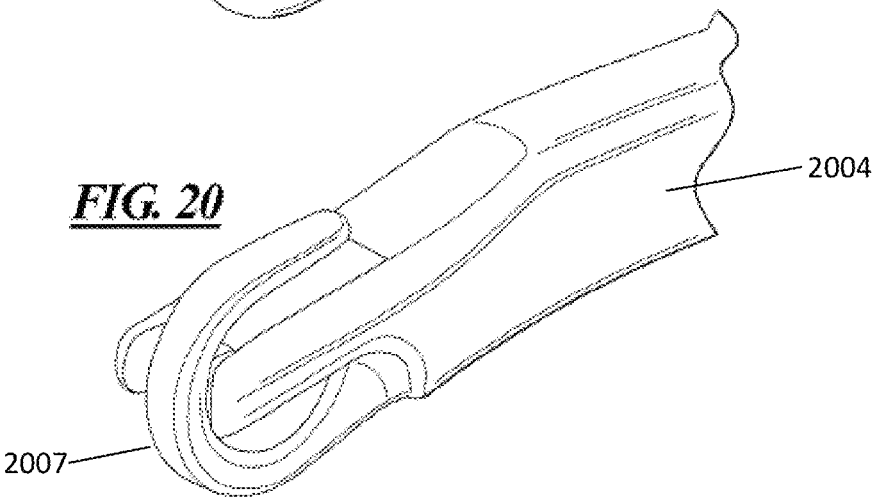

FIG. 21
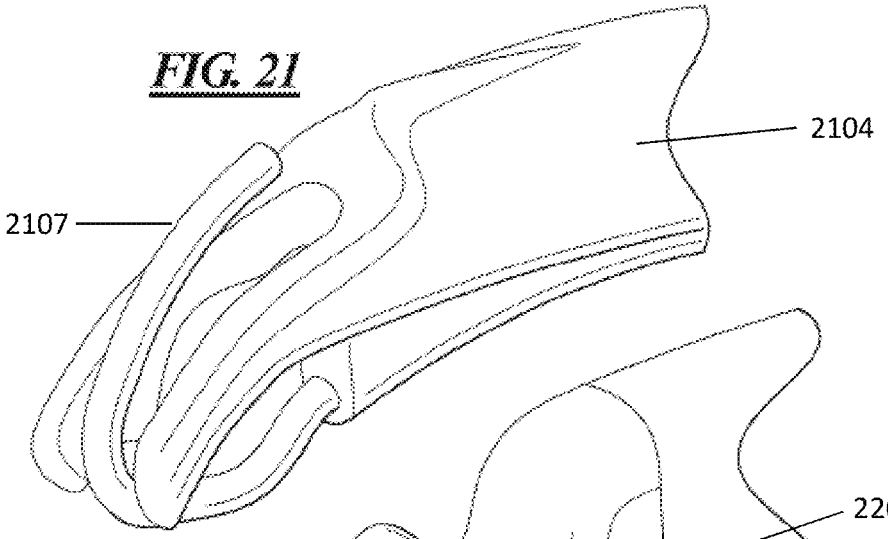
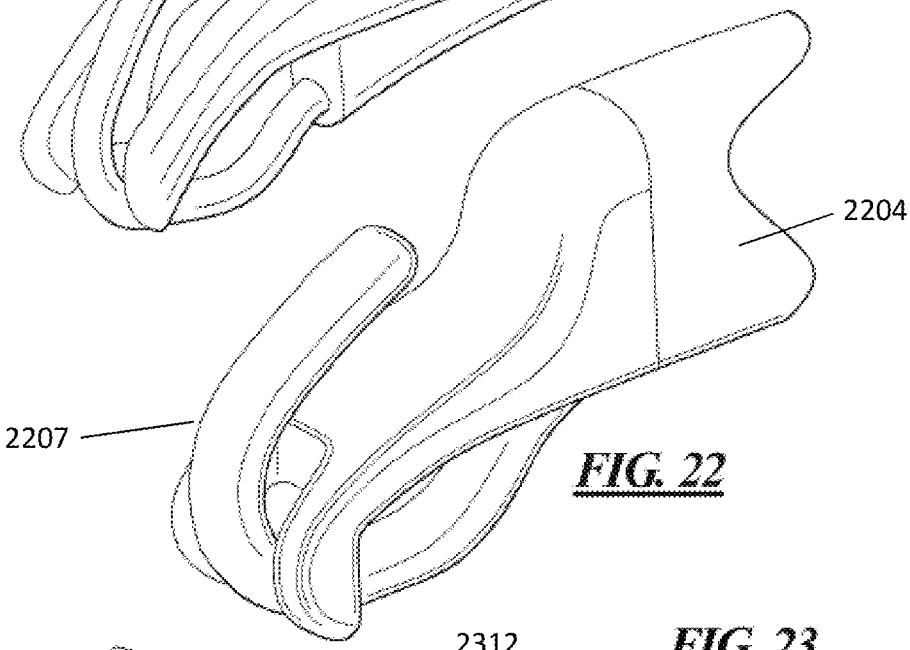
FIG. 22
FIG. 23
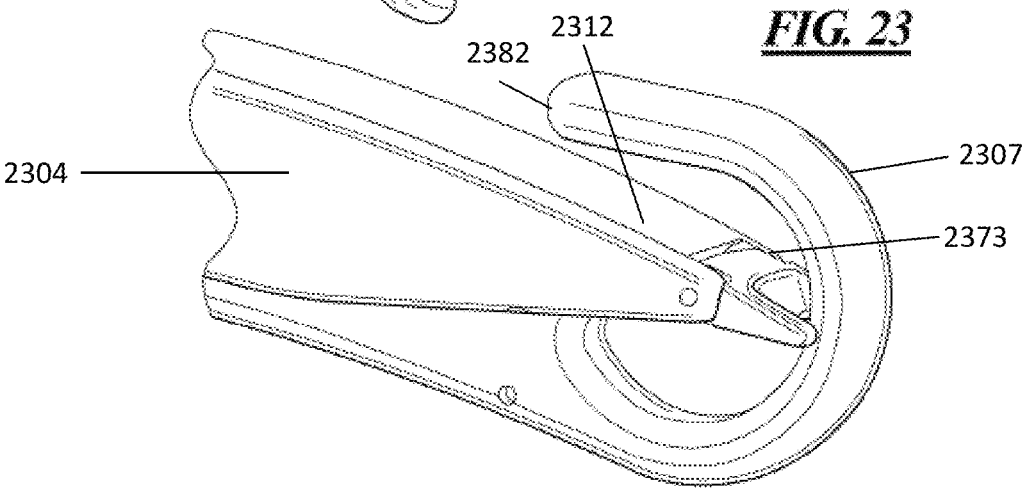

SLING BAR FOR PATIENT LIFT SLINGS

CROSS-REFERENCES TO RELATED APPLICATIONS

This application claims the benefit of priority to U.S. Provisional Patent Application No. 61/783,067, filed on Mar. 14, 2013, the contents of which are herein incorporated by reference in their entirety.

FIELD

This disclosure relates to overhead patient lift systems.

BACKGROUND

Motorized overhead patient lift systems are known for use in connection with lift straps, sling bars and patient lift slings to lift and transport patients for any number of reasons. Many of such motorized overhead lift systems typically operate like a winch and usually include a lift motor, a cylindrical lift drum driven by the lift motor, a housing for enclosing the motor and lift drum, and a lift strap affixed at one end within the lift drum for lifting or lowering a patient when the drum is rotated and the strap is respectfully either wound up on the lift drum or paid out from the lift drum. Typically, a sling bar is connected to the free end of the lift strap. Each end of a sling bar typically includes a load hook onto which the lift loops of a patient lift sling are hooked so that a patient can be lifted by the lift system.

However, the load hooks disposed at the ends of existing sling bars are problematic for several reasons. First, several sling bars include lift hooks that have spring-biased latches hingedly attached to the body of the sling bar, which serve to close the otherwise open hook loop by biasing the free end against the open end of the load hook. These locking gates are present to ensure that the lift loops on the patient slings do not accidentally become unhooked from the hooks at the ends of the sling bar. However, these hinged latches are not a structural part of the sling bar and are incapable of handling the lift loads. Occasionally, the lift loops can and do become positioned within the load hooks such that they are only wrapped on or around the hinged latch. When a patient is then seated in the patient sling with the lift loop in such position, the load placed on the hinged latch by the lift loop far exceeds the load capacity of the hinged latch, the latch breaks off from the sling bar, the lift loop becomes disengaged from the sling bar and the patient suddenly falls to the floor as one side of the patient sling is no longer supporting the patient's weight.

In addition, the lift hooks currently disposed at the ends of patient sling bars protrude freely into the air and otherwise are directed away from the body or cross bar portion of the sling bar. Accordingly, the free ends of the lift hooks are exposed for anyone to either catch a piece of clothing on, or catch a portion of the medical staff's or patient's body on. As such, existing lift hooks on sling bars currently pose an impalement risk to both patients and staff using and maneuvering the sling bars.

Accordingly, there is a need for a sling bar that retains the lift loops of a patient sling on the sling bar as well as reduces or removes any impalement risk from the lift hooks disposed at the ends of the sling bar. There is also a further need for a sling bar that does not utilize hinged, spring biased latches to retain the lift loops of the sling on the sling bar. As an alternative to sling bars having no latches, there is a need for sling bars containing latches designed to support a full lifting load from a lift loop, or alternatively, latches that are designed to open and release the lift loop if a lift loop places a lifting load on the latch.

BRIEF DESCRIPTION OF THE DRAWINGS

The present invention is described in detail below with reference to the attached drawing figures, wherein:

FIG. 18 is a partial front view of the lift hook end of an embodiment of the improved sling bar of the present disclosure.

FIGS. 19-22 are partial isometric views of the lift hook ends of various embodiments of an improved sling bar, illustrating various embodiments of lift hook shapes, contours of the top surface of the cross bars, and lift loop retention ear shapes.

FIG. 23 is a partial isometric view of the lift loop end of an embodiment of an improved sling bar, wherein the lift loop retention ears disposed at each end of the cross bar are hingedly connected to the cross bar at a location inside the curved hook shape of the lift hook, which hinged ears are spring biased about the hinge to fully extended positions relative to each end of the cross bar.

DETAILED DESCRIPTION

Figure 1:
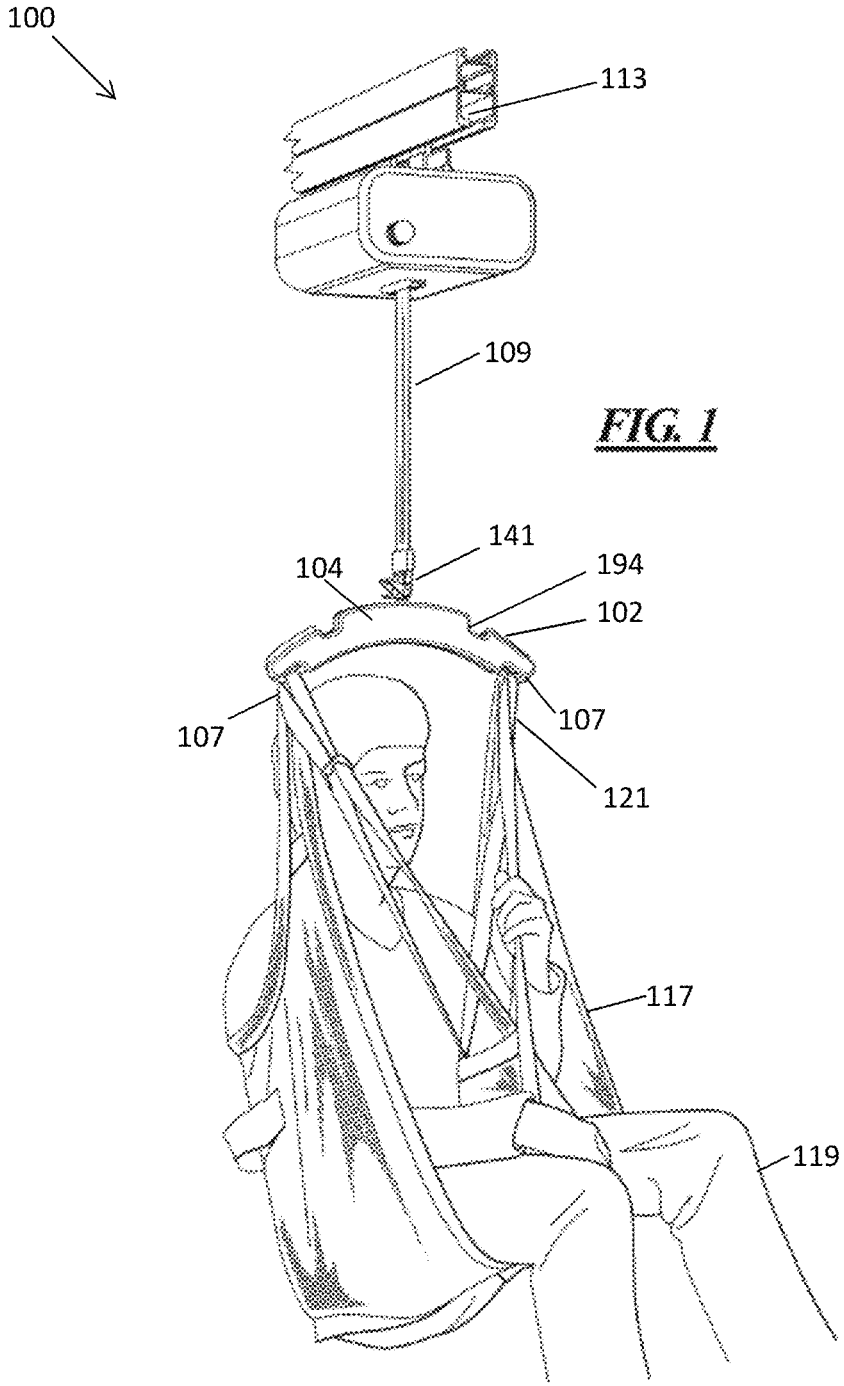
FIG. 1 is an isometric view of an embodiment of a new sling bar of the present disclosure.

Various embodiments now will be described more fully hereinafter with reference to the accompanying drawings, which form a part hereof, and which show, by way of illustration, specific embodiments. However, this invention may be embodied in many different forms and should not be construed as limited to the embodiments set forth herein. Rather, these embodiments are provided so that this disclosure will be thorough and complete, and will fully convey the scope of the invention to those skilled in the art. The following detailed description is not to be taken in a limiting sense.

Throughout the specification and claims, the following terms take the meanings explicitly associated herein, unless the context clearly dictates otherwise. The phrase "in one embodiment" does not necessarily refer to the same embodiment, although it may. Furthermore, the phrase "in another embodiment" does not necessarily refer to a different embodiment, although it may. Thus, as described below, various embodiments may be readily combined without departing from the scope or spirit of the present disclosure.

In addition, as used herein, the term "or" is an inclusive "or" operator, and is equivalent to the term "and/or," unless the context clearly dictates otherwise. The term "based on" is not exclusive and allows for being based on additional factors not described, unless the context clearly dictates otherwise. In addition, throughout the specification, the meaning of "a," "an," and "the" include plural references. The meaning of "in" includes "in" and "on."

Referring to FIGS. 1-4, an embodiment of a sling bar 102 for use in connection with patient lift systems is shown. For purposes of simplicity, a single end or two ends of a sling bar are illustrated in the drawings, while it will be understood that a sling bar may include additional ends (e.g., 3, 4, 6, etc.). The sling bar 102 is generally a horizontally positioned longitudinal bar having lift hooks 107 disposed at either end that is configured to be connected about the center of its length to either (1) the free hanging end a lift strap 109 that is operatively connected to a ceiling mounted overhead lift system 113, or (2) the lift end of the rigid lift arm of a mobile patient lift. A patient sling 117 used to lift and/or transport a patient is placed beneath the patient 119 whose weight is to be supported. The patient sling 117 is then connected to the sling bar 102 by attaching lift loops extending from the patient sling over the lift hooks 107 disposed at either end of the sling bar 102. The patient 119 may then be raised by winding up the lift strap 109 extending from the overhead ceiling mounted lift system 113 or raising the lift arm of the mobile patient lift. The lift hooks 107 at the end of sling bar 102 in turn pull upward on the lift loops 121 of the patient sling and support the active load of the patient 119 suspended there beneath.

Figures 2, 3, 4:
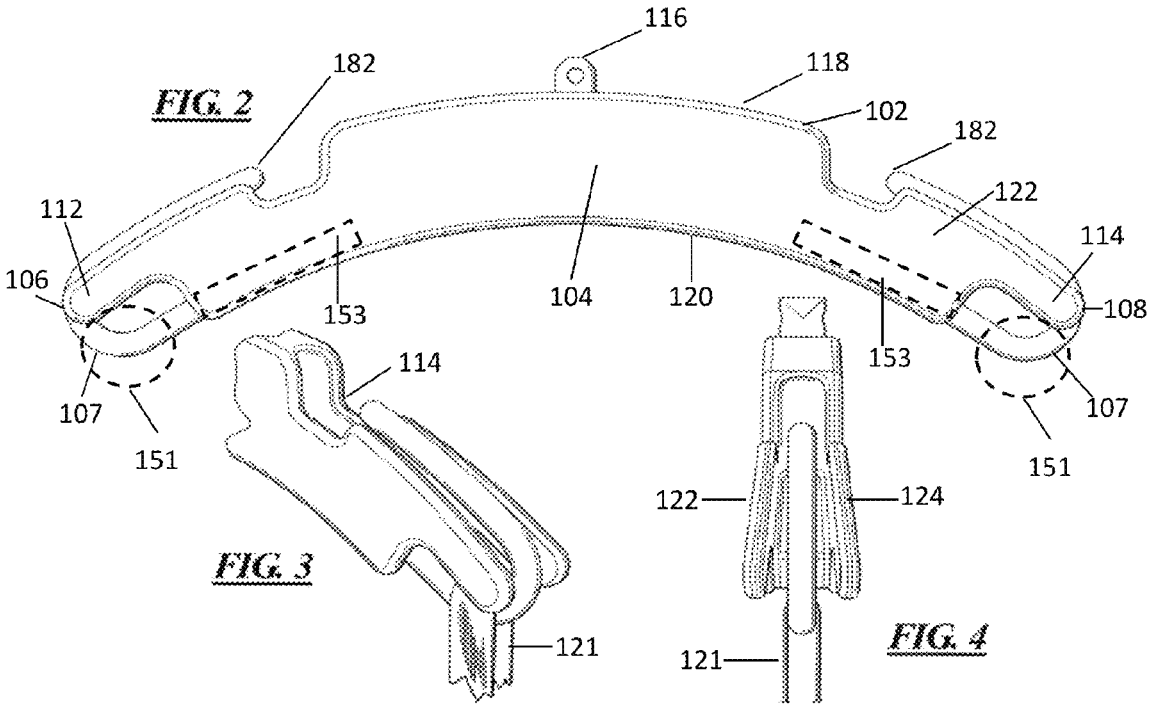
FIG. 2 is a front view of the embodiment of the new sling bar of FIG. 1
FIG. 3 is an isometric detail view of a lift hook end of the embodiment of the improved sling bar of FIG. 1.
FIG. 4 is a partial side isometric detail view of a lift hook end of the embodiment of the improved sling bar of FIG. 1.

Referring to FIGS. 1-2, a sling bar 102 of the present disclosure comprises a generally horizontally positioned cross bar 104 having opposite first and second ends 106, 108, a lift hook 107 disposed at and extending longitudinally outward from each end 106, 108 of the cross bar 104, a pair of lift loop retention ears 112, 114 connected to and extending longitudinally outward from each end 106, 108 of the cross bar 104, wherein each ear in the pair 112, 114 is located on opposite front 122 and back 124 sides of the lift hook 107 such that each pair of ears 112, 114 flanks its corresponding lift hook 107, and a central lift connector 116 centered along the length of the cross bar 104 for connecting to either the free hanging end of an overhead lift strap 109 or a lift arm of a portable lift system 100.

Cross Bar

Referring to FIGS. 1-2, in one embodiment, the cross bar 104 is a rigid beam that is curved in a downward direction, such that the ends 106, 108 of the cross bar 104 are located below a central portion of the cross bar. One embodiment of the cross bar 104 includes a top surface 118, a bottom surface 120, a front surface 122, and a back surface 124. The central lift connector 116 is disposed in the cross bar 104 at the longitudinal center thereof. The lift connector 116 defines a connection point for connecting the sling bar 102 to the lift system at a point located above the top surface 118 of the cross bar 104 at a horizontal centerline thereof. The cross bar's curve may be semi-circular, wherein the center point of the curved cross bar 104 is centered below the lift connector 116 at a predetermined distance below the cross bar 104. In this manner, the cross bar's center of mass is horizontally centered on the lift connector 116, but vertically located at a position that is lower relative to the sling bar's lift point than it would be if the cross bar 104 were a straight horizontal beam.

One benefit to the downward-curved cross bar 104 having a vertically lowered center of mass and a lift point just above the cross bar 104, is that the cross bar 104 resists rotating longitudinally out of its downward curved natural lift position, as compared to a straight or upward curved cross bar that has a center of mass that would be much closer to the cross bar's lift point. Another benefit to utilizing a downward curved cross bar 104 is that, during use, if the patient sling lift loops 121 are inadvertently looped onto just the cross bar 104 as opposed to the lift hooks 107 disposed at the ends of the cross bar 104, the downward curved contours of the cross bar 104 will aid the lift loop 121 in slidably moving outward and onto the lift hooks 107 disposed at the ends of the curved cross bar 104. In addition, a downward curved cross bar 104 provides additional clearance between the sling bar and a head of a patient 119 seated in a patient sling 117 suspended therefrom, so as to reduce the chance of the patient hitting his head on the sling bar during use.

However, while the above disclosed embodiment discloses a downward curved cross bar 104, alternate cross bar shapes may be used in alternate embodiments without departing form the scope of the present disclosure. For example, in alternate embodiments, the cross bar may be a straight cross bar, a chevron (or upside down "V") shaped cross bar, a wave shaped cross bar, a triangular shaped cross bar, or have any alternate shape than that disclosed above. In particular, the cross bar may any shape having a center of mass located below the point of connection to the overhead lift strap or lift arm of a portable list system, without departing from the scope of the present disclosure.

The cross bar 104 may be made of solid metal, such as for example, steel, titanium, aluminum, any number of metal alloys, or any other metal that is capable of supporting the desired loading conditions. In alternate embodiments, the cross bar 104 may be made of a combination of polymers and metals. The cross bar 104 may be a single solid beam having a continuous solid cross section. In alternate embodiments it may be partially hollow and include a system of internal trusses, or it may be fully hollow similar to a tubular beam. However, in still alternate embodiments, various structural materials and structural designs may be devised and combined so as to provide the strength characteristics necessary to support the desired loads without departing from the scope of this disclosure. In general, the cross bar 104 has substantially no sharp edges, as all surfaces and edges are smooth and/or rounded so as to avoid any potential wear on the patient slings 117 that will be loaded on the sling bar 102.

Central Lift Connector

Referring to FIGS. 1-2, the cross bar 104 has disposed therein a central lift connector 116 that is located about the longitudinal or horizontal center line of the cross bar 104. The central lift connector 116 provides the connection point to the lift strap 109 of an overhead patient lift system or the lift arm of a portable lift system. The central lift connector 116 may be integrally formed within the cross bar 104 or it may be a separate component that is installed into or on the cross bar 104. In one embodiment, the lift connector may be a closed rigid loop formed along the top surface of the cross bar 104 at the longitudinal center of the cross bar 104. In another embodiment, the central lift connector is a separate connector that is installed into a vertical hole defined in the horizontal centerline of the cross bar 104. Such an installed connector may be affixed by locking pins, interference fitting, threaded fasteners, or other such known fastening techniques and structures.

In one embodiment, the central lift connector 116 is a swivel connector secured into the vertically oriented hole in the center of the cross bar 104, which permits the sling bar 102 to rotate in a horizontal plane about a vertical axis through cross bar 104. The swivel connector permits patients to be rotated about a vertical axis while being suspended from the sling bar 102. In another embodiment, the central lift connector 116 may include a pair of perpendicular hinges that, when the cross bar 104 hangs freely, have axes of rotation that are perpendicular to the vertical rotational axis of the swivel connector and are also oriented perpendicular to each other. This combination of hinges and swivel create a central lift connector 116 having 3-degrees of rotational movement, which in use, makes it easier to maneuver the sling bar 102 and patient suspended there below. In an alternate embodiment, the pair of hinges may be replaced with a ball joint or other such connection that, together with the swivel connection, will provide for movement in 3-degrees of rotational freedom. In addition, the central lift connector 116 may include a quick release hook system 141 similar to that currently in use by Liko and Hill-Rom to provide for quick connection and disconnection to a lift strap 109 of an overhead lift system or lift arm of a portable lift.

Lift Hooks

Referring to FIGS. 1-4, each end of the cross bar 104 includes at least one lift hook 107 protruding or extending longitudinally outward therefrom. The lift hooks 107 are rigidly connected to the cross bar 104 such that the cross bar 104 and lift hooks 107 act as a single rigid structural component. In one embodiment, the shank portion of each lift hook 107 is connected to and extends from the ends of the cross bar 104 at a bottom side of the cross bar 104. The shank portion 153 of the lift hooks 107 then extends downward and further outward from the ends of the cross bar 104 before transitioning to the bend portion 151 of the lift hooks 107. The bend portion 151 of the lift hooks 107 bend upward from the shank portion 153 and curve in a direction back toward the ends of the cross bar 104. The point portion 182 of the lift hooks 107 extend from the upper end of the curved bend portion 151 to a blunt end point that is located at a predefined distance from the ends of the cross bar 104 and located at a top side of the cross bar 104. The lift hooks 107 are thus oriented in a vertical plane and protrude from the ends of the cross bar 104.

In one embodiment, when viewed from a front side profile view, a contour line for the upper most surface of the point portion of the lift hook 107 is aligned with the contour line for the top surface of the cross bar 104, such that the two contour lines define a single continuous contour without any misalignment there between. In an alternate embodiment, the contour line for the upper most surface of the point portion of the lift hook 107 sits at or below the contour line for the top surface of the cross bar 104.

Ears

Referring to FIGS. 3-4, each end of the cross bar 104 includes a pair of ears 112, 114 extending longitudinally therefrom in the same general direction as the lift hooks 107. One ear extends longitudinally from the end of the cross bar 104 at a front side thereof and is located generally in front of the lift hook 107, and the other ear in the pair of ears 112, 114 extends longitudinally from the end of the cross bar 104 at a back side thereof and is located generally behind the lift hook 107 and opposite the front hook. In this manner, each pair of ears 112, 114 defines a space there between in which a lift hook 107 is disposed. In one embodiment, each of the lift hook 107 and two ears 112, 114 in a pair of ears 112, 114 are generally parallel to each other. However, in alternate embodiments, each of the two ears 112, 114 may flair out slightly away from each other and the lift hook 107 that is located there between as the ears 112, 114 extend away from the ends of the cross bar 104. The ears 112, 114 extend a sufficient distance from the ends of the cross bar 104 such that, when viewed in a front side profile view, at least a portion of the inner concave bent surfaces of the bend portions 151 of the lift hooks 107 are not visible because they are blocked from view by the ears 112, 114 protruding longitudinally past such inner bend surfaces.

In addition, when viewing the sling bar in a front side profile view, the lowermost inner surface of the bend portion 151 of the lift hooks 107 is visible and a space is otherwise defined and visible between the bottom side of the ears 112, 114 and the lowermost inner surface of the bend portion 151 of the lift hooks 107. It is in this space that a lift loop 121, or multiple lift loops 121, of a patient sling will reside when they are looped onto the lift hooks 107 and the sling bar is being used to lift a patient seated in the patient sling. In an alternate embodiment, the lower most inner surfaces of the transition between the shank portion 153 and the bend portion 151 of the lift hooks 107 are visible. In such an embodiment, the aforementioned space for the lift loops 121 is otherwise visible between the bottom side of the ears 112, 114 and the lowermost inner surface of the bend and shank portions 153 of the lift hooks 107.

In one embodiment in which the shank of the lift hook 107 follows the contours of the bottom side of the cross bar 104, the aforementioned space is created by providing a notch in a lower portion of each ear 112, 114 such that the notches create the space between the inner surface of the lift hook 107 and the lower portion of the notches in the ears 112, 114.

In an alternate embodiment, the defined space for accommodating the lift loops 121 of the patient sling is created by providing ears 112, 114 that follow the upper contours of the cross bar 104, but whose height is only a fraction of the vertical thickness of the cross bar 104, thus defining a space below the ears 112, 114 and above the inner concave curved surface of the bend portion 151 of the lift hook 107.

In still another embodiment, the defined space for accommodating the lift loops 121 is created by providing ears 112, 114 that are a fraction of the vertical thickness of the cross bar 104, and are positioned not in line with the upper or lower contour lines of the cross bar 104, but located somewhere between the contour lines of the cross bar 104.

Figure 8:
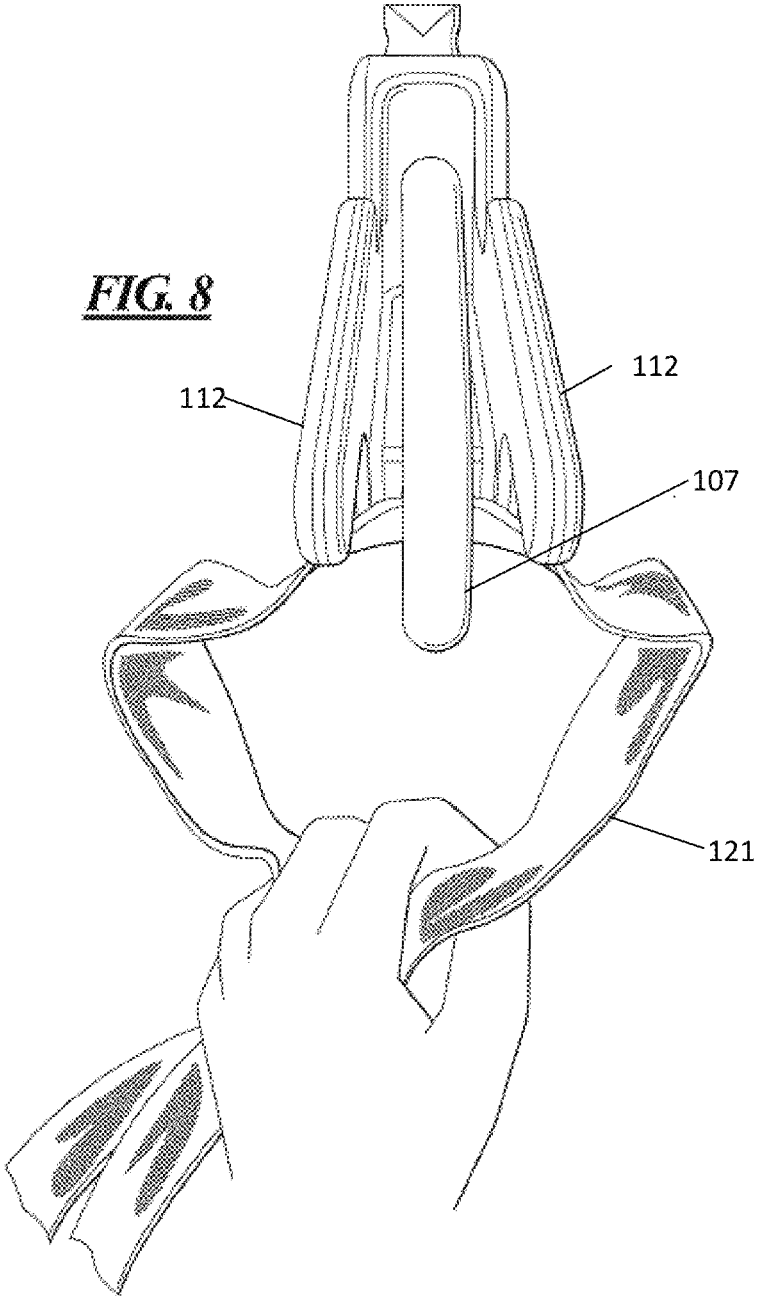
FIG. 8 is a partial side view of an embodiment of the sling bar as disclosed herein illustrating the retention ears on the sling bar preventing a loose lift loop from inadvertently being removed from the sling bar when the lift loop is raised in an upward direction relative to its loaded hanging position.

Regardless of the differences between the various embodiments that serve to define the space for accommodating the lift loops 121 on the patient sling 117, the space between the lift hooks 107 and the ears 112, 114 makes it possible to easily and visually determine when the lift loops 121 are properly loaded on the sling bar 102. Furthermore, as shown in FIG. 8, when a patient sling is suspended from the lift hooks 107 by the lift loops 121, each pair of ears 112, 114 serves as a pair of physical stops to prevent the lift loops 121 from being removed from the lift hooks 107 when the lift loops are merely lifted directly upward relative to the lift hooks 107. As will be discussed in further detail below, removal of the lift loops 121 from the sling bar requires specific manipulation of the patient sling's lift loops 121 relative to both the lift hook 107 and the pair of ears 112, 114.

The lift hooks 107 are made from steel, titanium, or other such structural metals or metal alloys capable of supporting the loading conditions to which the lift hooks 107 will be subjected. In alternate embodiments, the lift hooks 107 may be made of such materials that will not suddenly break or shatter, should the lift hooks 107 become overloaded.

In one embodiment, the lift hooks 107 may be integrally formed with the cross bar 104 and ears 112, 114, as by molding or other such forming processes. In alternate embodiments, the lift hooks 107 may be structurally fastened to the cross bar 104 in a permanent or removable manner. In still another embodiment, the lift hooks 107 and central lift connector 116 may be integrally formed and connected together as a single solid piece, for example generally in the shape of an upside down "Y," with the cross bar 104 being secured thereto or there over. In such an embodiment, the upside down "Y" would be made of a structural metal and the cross bar 104 could be made from a structural polymer, as it would not be directly subjected to the same loading conditions as the main upside down "Y" structure.

One benefit of having a sling bar 102 in which the point portion 182 of the lift hooks 107 follow the smooth top contour lines of the cross bar 104 is that risk of impalement by the end point and point portion of the lift hook 107 is virtually eliminated, as the end point and point portion no longer protrude or extend beyond the smooth contours of the cross bar 104.

Another benefit of a sling bar utilizing rigid retention ears 112, 114 to prevent removal of the lift loops 121 of a patient sling 117, as disclosed herein, is the elimination of non-structural spring loaded latches used to retain lift loops 121. The present disclosure eliminates the possibility that a lift loop 121 will become unseated from the bend of a lift hook 107 and become wrapped only on the spring loaded latch, which may then break away from the sling bar when it becomes subjected to lateral loading upon further active loading of the lift loop. Consequently the risk that a patient may be dropped from a patient sling if the spring loaded clip fails in this manner is eliminated because the spring loaded clip is not strong enough nor intended to support any such active load conditions.

Operation

Figure 5:
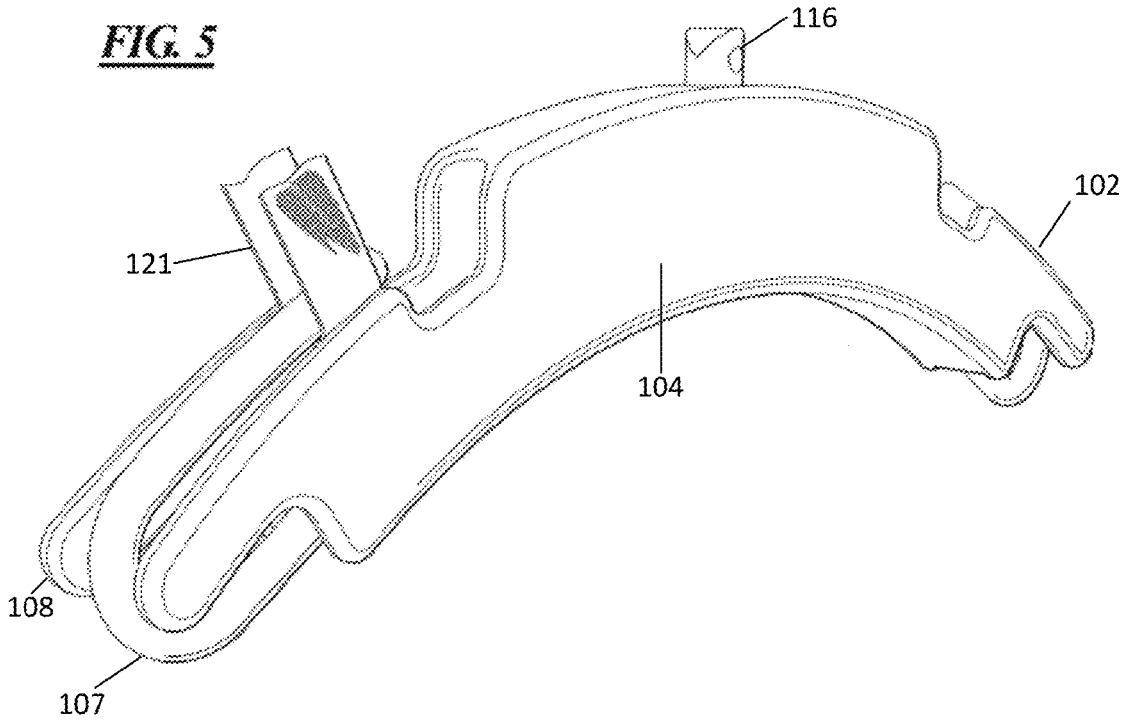
FIGS. 5-7 are partial isometric detail views of a lift hook end of the embodiment of the improved sling bar of FIG. 1 illustrating the procedure for placing the lift loops of the patient sling onto the lift hooks of the improved sling bar.
Figure 6:
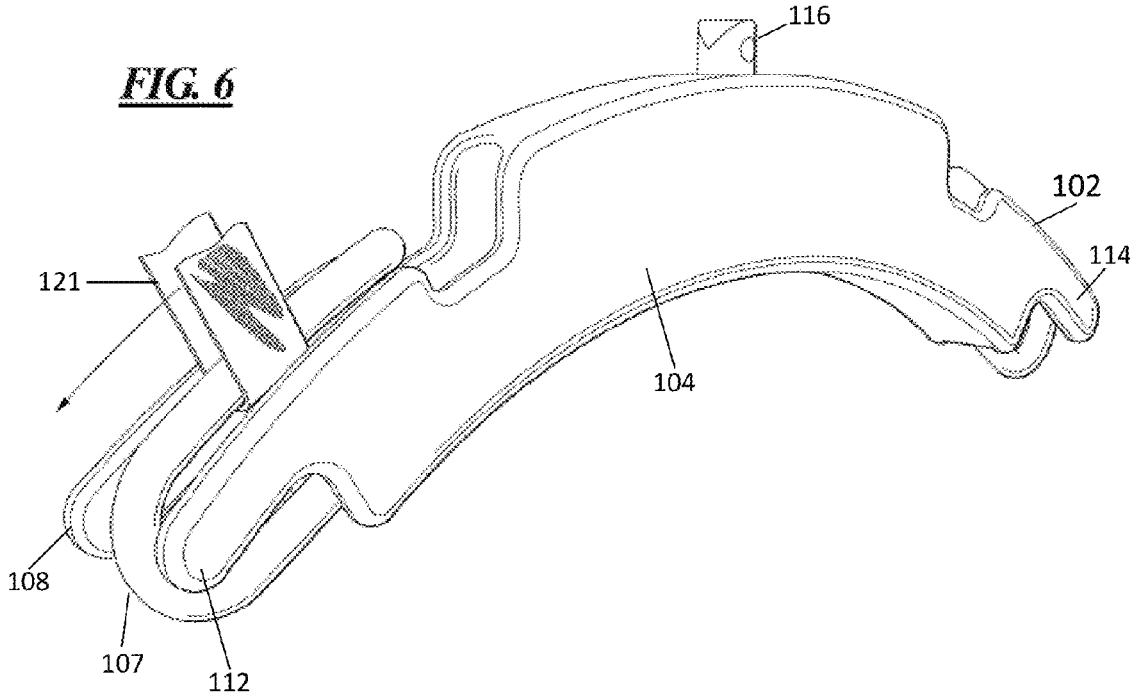

Referring to FIGS. 5-8, to operate the sling bar 102 of the present disclosure and load a patient sling 117 thereon, the sling bar 102 is connected to either the free end of a lift strap 109 from an overhead patient lift system or the lift arm of a portable patient lift. A caretaker, patient, or other user determines which of the lift loops 121 on the patient sling 117 to place onto the lift hooks 107 of the sling bar 102. Referring to FIG. 5, the strap that forms the selected lift loop 121 is pinched together such that the lift loop 121 forms a narrow loop of material. The narrow lift loop 121 is positioned such that the looped end to be placed onto the lift hook 107 of the sling bar 102 is pointing in a downward direction. The narrowed looped end of the lift loop 121 is slid over the free blunt end point of the lift hook. Referring to FIG. 6, the lift loop is pulled in a direction perpendicular to the longitudinal axis of the point portion of the lift hook 107, so as to maintain constant tension on the lift loop 121. While still under tension, the lift loop 121 is then slid along the length of the point portion of the lift hook 107 to the bend portion 151.

Figure 7:
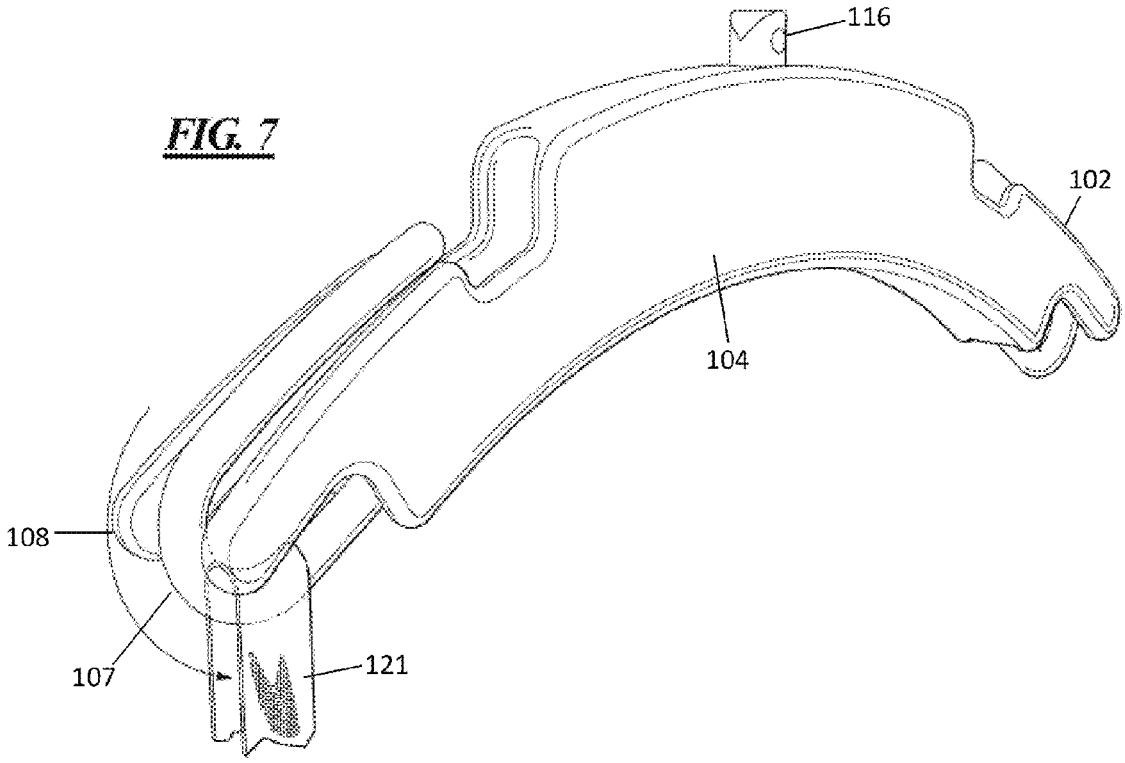

Referring to FIGS. 6 & 7, while maintaining the tension on the lift loop 121, the lift loop 121 is further slid downward around the bend portion 151 of the lift hook 107, between the retention ears 112, 114 protruding from the cross bar 104, and finally seated at the bottom of the bend portion 151, or bend and shank portions 153. The lift loops 121 are in their correct position when they are seated in the lift hooks 107 at the lowest vertical portion of the bend portion 151, or band and shank portion 153, of the lift hook 107. The patient or user who is seated below the sling bar 102 in the patient sling may then be lifted by raising the sling bar 102, whereby the lift hooks 107 of the sling bar 102 pull upward on, and support, the lift loops 121 of the patient sling.

To remove the patient sling and lift loops 121 from the sling bar 102, the active load of the patient is first removed from the lift sling 117, such that there is slack in the lift loops 121 of the patient sling. Each lift loop 121 is then pulled downward to place the lift loop under tension against the inner curved surface of the lift hook. The lift loop is then slid upwards along the bend portion 151 of the lift hook, between and past the retention ears 112, 114, and slid fully off of the point portion of the lift hook. When all lift loops 121 have been removed from the lift hooks 107, the patient sling has been successfully removed from the sling bar 102.

The ears 112, 114 adjacent the lift hook 107 are configured such that, in order to load or unload the lift loops 121 onto or off of the lift hooks 107 of the sling bar 102, the strapping, cable, rope, or other such material that forms the lift loops 121 must pass between the lift hook 107 and each ear on either side of the lift hook. This most easily accomplished by placing the strapping under tension in a direction that is radially outward from a center of the bend portion 151 of the lift hook 107 while sliding the lift loop 121 on/along the length of the lift hook 107. However, alternate methods of loading the lift hooks 107 with the lift loops 121 of a patient sling are contemplated while not departing from the scope of the present disclosure. The specific configuration of utilizing lift loop retention ears 112, 114 permits a user to load and unload the lift loops 121 of a patient sling on/from the sling bar's lift hooks 107 with a single hand.

Alternate Embodiments

Figure 9:
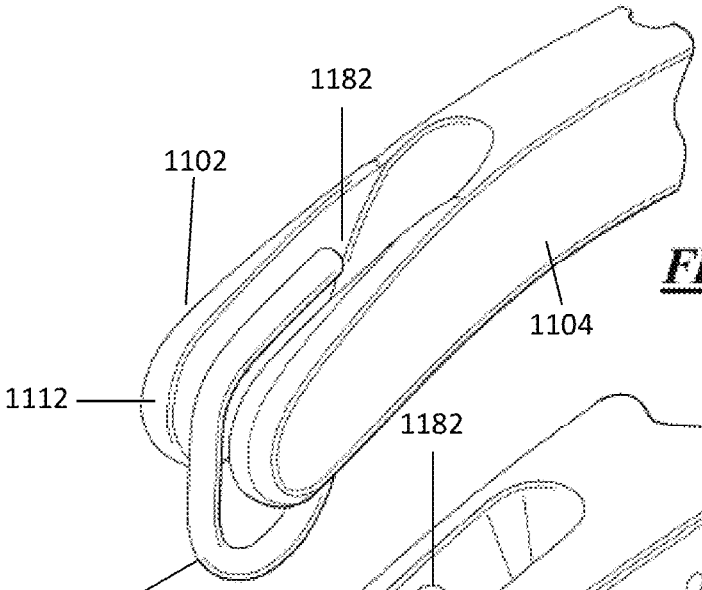
FIGS. 9-11 are partial isometric views of alternate embodiments of the lift hook ends of an improved sling bar of the present disclosure.
Figure 10:
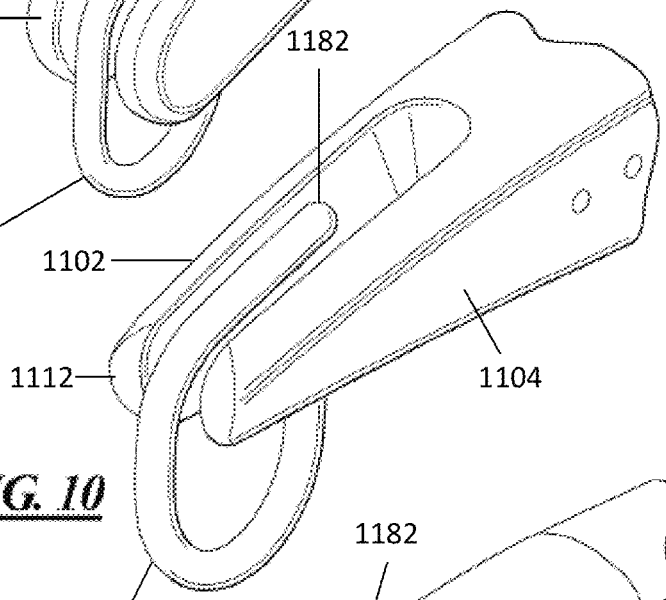
Figure 11:
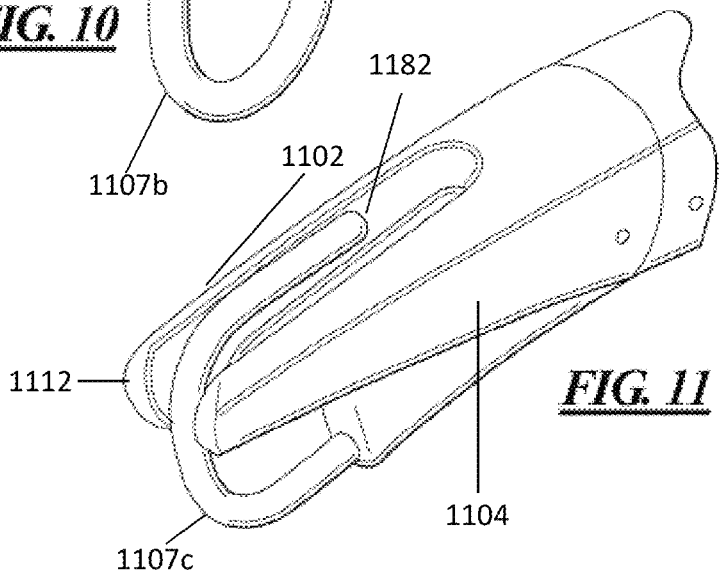
Figure 12:
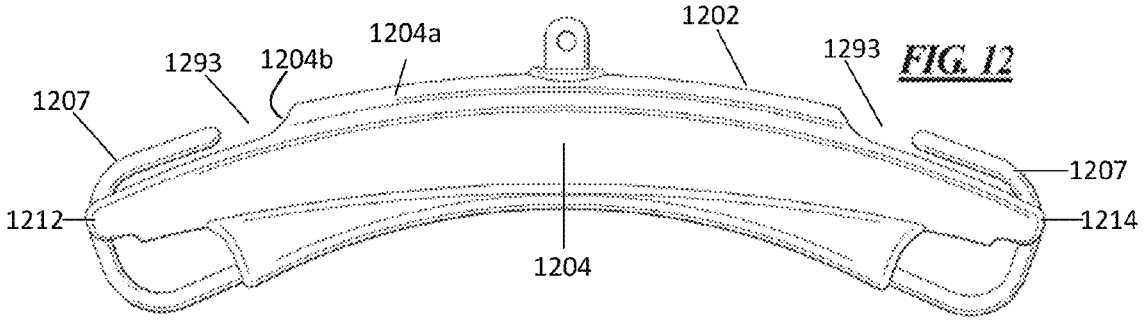
FIG. 12 is a front view of an embodiment of an improved sling bar of the present disclosure.
Figure 13:
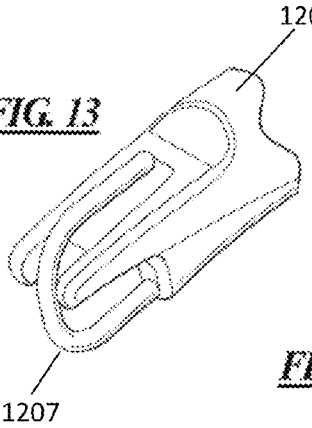
FIG. 13 is a partial isometric view of the lift hook disposed at an end of the embodiment of the improved sling bar of FIG. 12.
Figure 14:
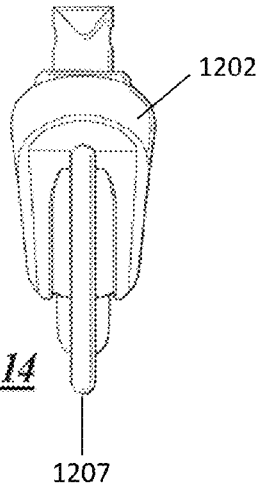
FIG. 14 is a side view of the embodiment of the improved sling bar of FIG. 12.
Figure 15:
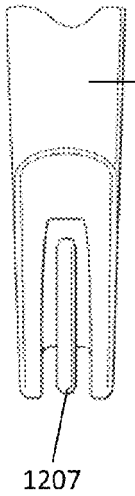
FIG. 15 is a partial top view of the lift hook disposed at an end of the embodiment of the improved sling bar of FIG. 12.
Figure 16:
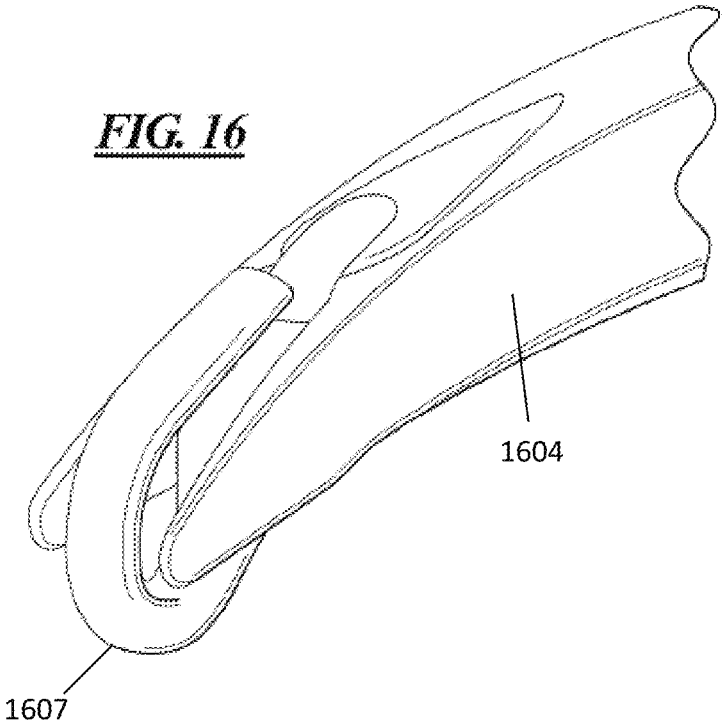
FIGS. 16-17 are partial isometric views of alternate embodiments of the lift hook ends of an improved sling bar of the present disclosure.
Figure 17:
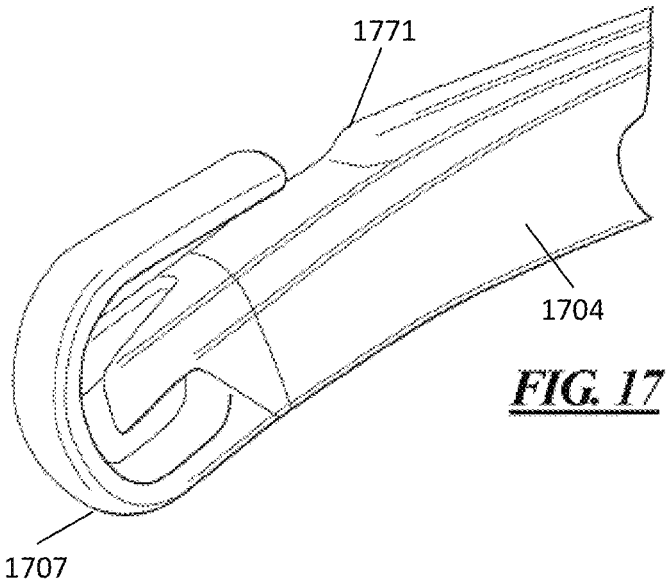

Referring to FIGS. 9-11, alternate embodiments of the sling bar 1102 of the present disclosure are shown. As shown, each of the ends of the cross bar 1104 have longitudinally directed slots defined in a top surface thereof. In such embodiments, the point portion of each lift hooks 1107*a* to 1107*c* extend from its bend portion into the longitudinal slots in the top surface of the cross bar 1104, such that the top outer surface of the lift hook 1107*a* is generally aligned with the curved contour line of the top surface of the cross bar 1104. In this regard, the point portion 1182 of each lift hook 1107*a* to 1107*c* is situated within its own slot, so that they do not protrude up past the top surface contour line of the cross bar 1104. In this manner, the risk of any impalement on the lift hook (e.g., 1107*a-c*) is eliminated.

Referring further to FIGS. 9-10, the lift hooks 1107*a-c* that are shown include a bend portion that bends vertically downward from the shank portion such that the bend portion drops below the bottom of both the cross bar 1104 and shank portion of the lift hook 1107*a-b*. The bend portion then bends 180-degrees back upward in a vertical direction before further bending back toward the end of the cross bar 1104. In such an embodiment, as in some previously disclosed embodiments, the bend portion of the lift hook 1107*a-b* passes between the ears 1112 of the sling bar 1102 and transitions to the point portion of the lift hook. Accordingly, a bottom portion of the lift hook (e.g., 1107*a-b*) drops below the bottom contour line of the cross bar 1104 when viewed in a front profile view.

Referring to FIGS. 12-15, in still other alternate embodiments of the presently disclosed sling bar 1202, an otherwise continuous curved top surface of the cross bar 1204 may be stepped-down towards the ends thereof. In this manner, the step-down defines a first top surface 1204*a* and a second stepped-down top surface 1204*b* towards each end of the cross bar 1204, which second stepped-down top surface 1204*b* is lower than the first top surface 1204*a*. Thus, in a front side profile view, the cross bar's top contour line is actually a stepped contour line. In such an embodiment, the point portion of the lift hook 1207 extends into the open area created by the stepped-down region of the cross bar 1204, such that outermost surface of the point portion is located at or below the first top surface and a predetermined distance above the second stepped-down surface. A gap 1293 is present between the surface of the point portion of the lift hook 1207 and the second stepped-down surface 1204*b*. The gap should at least be large enough to permit a lift loop to be slidably passed between the point portion of the lift hook 1207 and the cross bar 1204, so that the lift loops of a patient sling may be properly loaded onto the lift hooks 1207. As with previously disclosed embodiments, the ears 1212, 1214 extend longitudinally past the bend portion of the lift hooks 1207 to aid in lift loop retention. A large space is created between the bottom portion of the ears 1212, 1214 and the lowermost bend portion of the lift hook 1207 to accommodate one or more lift loops 1221 loaded on the lift hooks 1207.

As disclosed above, the downward curvature of the first top surface of the cross bar 1204 serves to help with proper seating of the lift loop, should a lift loop be inadvertently hooked only on the cross bar 1204. The weight of the patient sling and lift loop will cause the lift loop to slide along the first top surface 1204*a* of the cross bar 1204 where it intersects the step-down. When it reaches the step down 1204*b*, the lift loop slides down the step-down 1204*b* to the second top surface at the lift hook 1207 end. The lift loop will continue to slide such that it slides between the point portion of the lift hook 1207 and the cross bar 1204, where it can be manipulated to be fully seated on the lift hook.

Each of FIGS. 16-22 show alternate embodiments of variations of the lift hook ends (1607 to 2207) of cross bars (1604 to 2204) having stepped-down ends similar to those disclosed above. Each includes variations on the cross sectional shape of the lift hook, the specific geometry that defines the overall bent shape of the lift hook, the specific shape of the ears, and in some cases, the addition of a longitudinal bump (e.g., 1771 and 1871) to the top surface of the cross bar to create the stepped-down geometry and top surface contour lines as disclosed herein. All of the aforementioned and depicted variations are within the scope of the present disclosure.

Referring further to FIG. 1, in an alternative embodiment, as opposed to utilizing a stepped-down top surface of the cross bar 104, the cross bar 104 may include a notch 194 in the top surface thereof that extends fully through the front and back surfaces 122, 124 of the cross bar 104. The cross bar 104 may additionally include a longitudinally directed slot or groove, as previously disclosed herein, that is centered in the top surface of the cross bar 104 and extends from the notch 194 through the end of the cross bar. In such an embodiment, the point portion of the lift hook 107 extends into the longitudinal slot, such that the blunt end point stops within the notch 194. A gap is present between the surfaces of the point portion of the lift hook 107 and the upper surfaces in the cross bar 104 created by both the notch and groove. The gap should at least be large enough to permit a lift loop 121 to be slidably passed between the point portion of the lift hook 107 and the top surfaces of the cross bar 104, so that the lift loops 121 may be loaded onto the lift hooks 107.

In such embodiments containing either a stepped-down top surface or a notch and slot, the point portion and blunt end point of the lift hook, which together otherwise follow the contours of the top surface of the cross bar 104, are made more accessible to a user. This in turn increases the ease with which the lift loops 121 of a patient sling may be looped over the point portion of the lift hooks 107 for proper loading of the patient sling.

Figure 24:
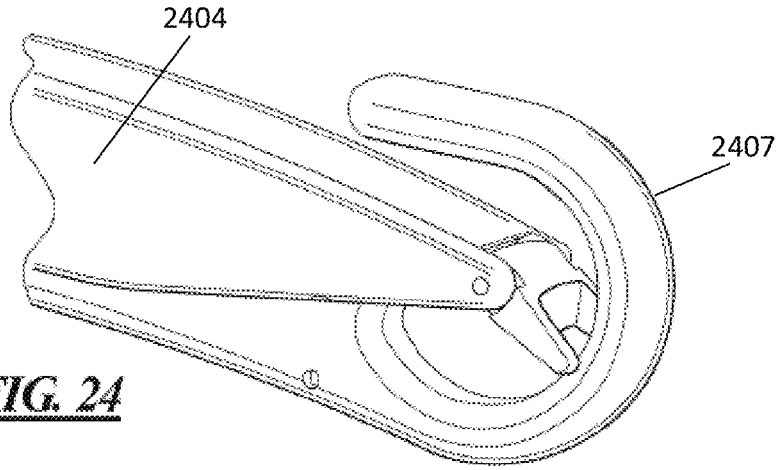
FIG. 24 is a partial isometric view of the sling bar of FIG. 23 illustrating the biased spring loaded ears in a deflected position about the hinge pins.
Figure 25:
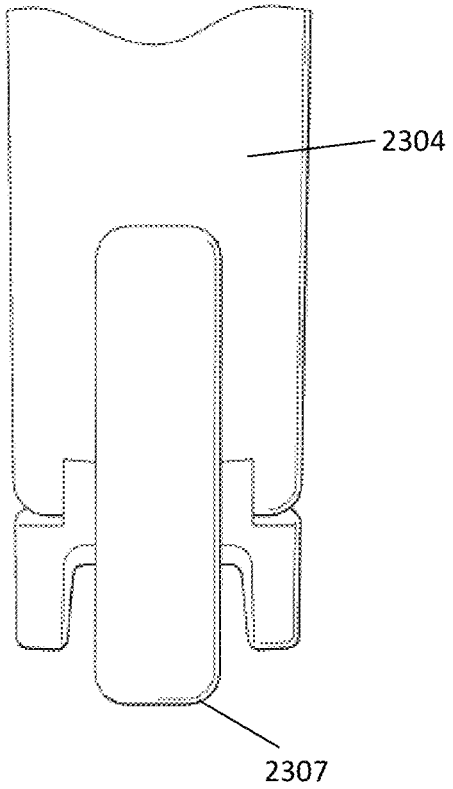
FIG. 25 is a partial top view of the sling bar of FIG. 23 illustrating the spring biased retention ears in an extended position relative to the cross bar.

Referring to FIGS. 23-25, in various alternate embodiments, the top surface of the cross bar (2104, 2204, 2304) slopes down toward the lift hook (2107, 2207, 2307) ends and passes below the point portion of the lift hook. In one example, the lift loop retention ears 2312 disposed at the ends of the cross bar 2304 are made part of a separate, generally "U" shaped, spring loaded latch piece 2373 that is hingedly affixed to the end of the cross bar 2204. The hinged connection is a structural connection capable of handling (e.g., withstanding) side loads placed thereon. The spring loaded latch 2373 comprises a pair of ears 2312 and is biased to extend longitudinally outward from the end of the cross bar 2304 and position each of the ears 2312 on opposite sides of the bend portion of the lift hook 2307. The spring loaded latch 2373 and ears 2312 may be deflected about the hinge in a downward direction toward the shank portion of the lift hook 2307. A physical stop between the latch 2373 and the end of the cross bar 2304 prevents the pair of ears 2312 from being deflected in an upward direction past its naturally biased longitudinal position.

To load a patient sling on the present embodiment having a spring loaded latch 2373, a lift loop from a patient sling need only be looped over the point portion 2382 of the lift hook 2373 and pulled vertically downward while situated above or on top of the ears 2312 of the spring loaded latch 2373. The force of pulling downward on the lift loop forces the spring loaded latch 2373 and ears 2312 to hingedly deflect in a downward direction. The lift loop then slides down the spring loaded latch 2373 and onto the bend portion of the lift hook 2307 until the lift loop is able to pass between the lift loop retention ears 2312 and the lift hook 2307. Once the lift loop slides between the lift ears 2312, the lift loop is properly seated and the spring loaded latch 2373 and ears 2312 spring back to their naturally biased position extending longitudinally from the end of the cross bar 2304. Accordingly, to load the lift loop onto the lift hook 2307 of the present embodiment utilizing a spring loaded latch 2373 and retention ears 2312 does not require the aforementioned specific manipulations of the lift loop. However, as the spring loaded latch 2307 does not deflect in an upward direction past its fully extended position, the removal process of the lift loop does require the aforementioned unloading manipulation of the lift loop 2307.

Clamp Latch

Figure 26:
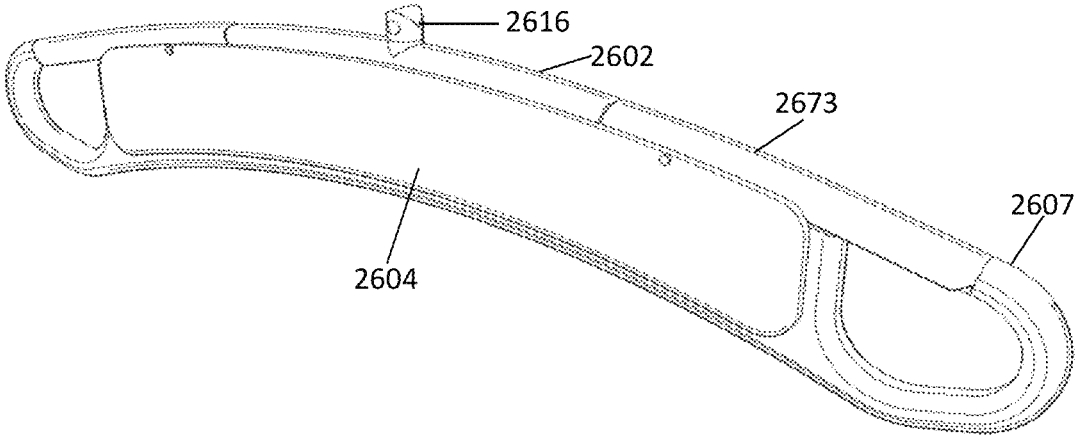
FIG. 26 is an isometric view of a sling bar of the present disclosure, having spring loaded clamp latches disposed at each end thereof.
Figure 27:
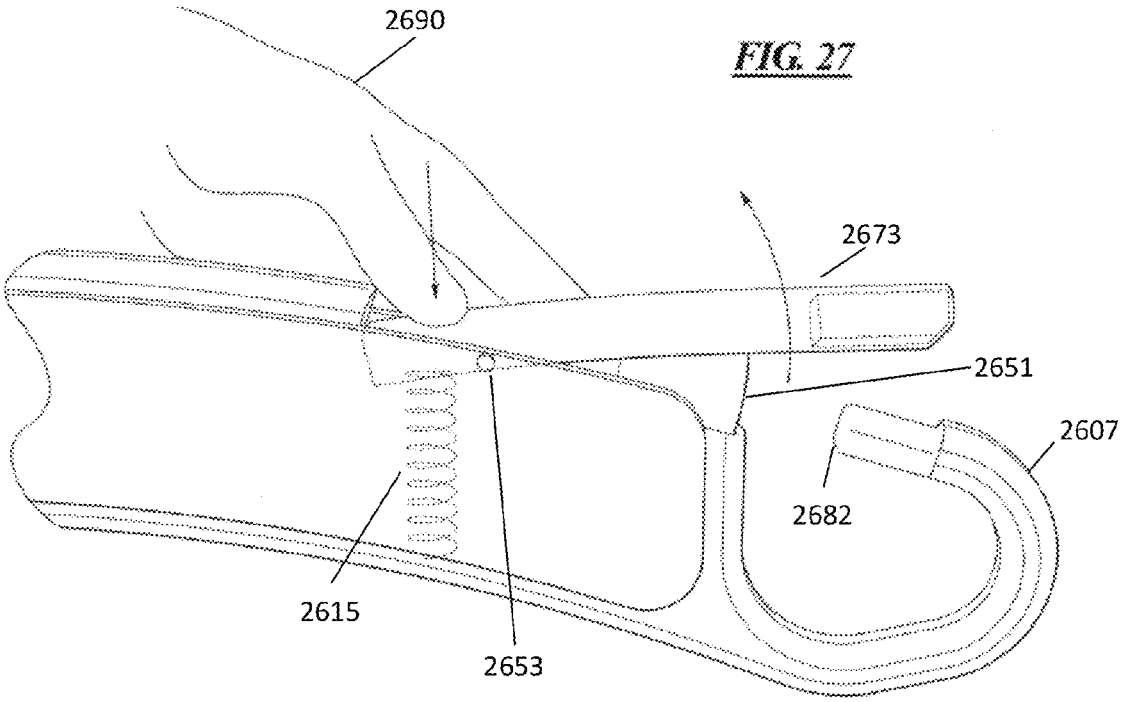
FIG. 27 is a front view of the sling bar of FIG. 26, illustrating the actuation of a spring loaded clamp latch at one end of the sling bar.
Figure 28:
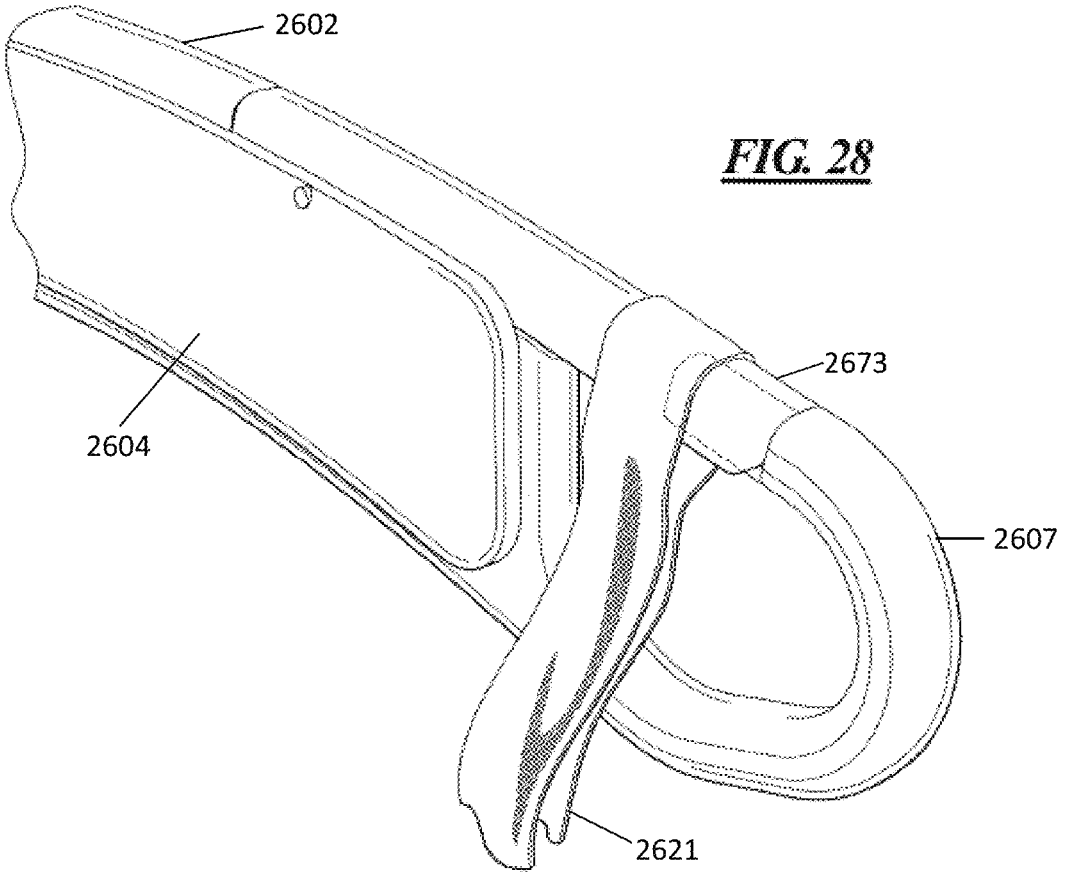
FIG. 28 is a partial isometric view of the sling bar of FIG. 26, illustrating a lift loop installed and pulling down on just the clamp latch of the present disclosure at one end of the sling bar.

Referring to FIGS. 26-28, an alternate embodiment of a new sling bar 2602 is shown. In such an embodiment, the sling bar 2602 may comprise a horizontally positioned downward curved cross bar 2604 having opposite first and second ends, a central lift connector 2616 centered along the length of the cross bar 2604 for connecting to either the free hanging end of an overhead lift strap or a lift arm of a portable lift system, a lift hook 2607 extending longitudinally outward from each end of the cross bar 2604, and a spring loaded latch hingedly connected to the cross bar 2604, which latch 2673 is biased to clamp downward onto a tip section of the lift hook's point portion and close off the hook opening defined between the blunt end point of the lift hook 2607 and either the cross bar 2604 or the shank portion of the lift hook 2607.

In such an embodiment, the spring loaded latch 2673 disposed at each end of the cross bar 2604 is configured as a spring-biased lever having a hinged connection to either the shank of the lift hook 2607 or the cross bar 2604. The hinge point, or fulcrum, of the latch is located at a point between a spring-biased release end of the latch and a gate end of the latch. The release end of the latch is generally positioned adjacent the end of the cross bar 2604 and includes a compression spring or leaf spring 2615 disposed between a bottom surface of the latch 2673 and a top surface of either the shank portion of the lift hook 107 or an upper surface of an end of the cross bar 2604. The spring 2615 can alternatively be any type of spring that elastically resists compression or deflection forces and that otherwise biases the release end of the latch in an upward direction and the gate end of the latch in a downward direction. When no outside forces other than the spring are acting on the latch, the gate end of the latch 2673 is biased to a closed, downward clamped position over the tip section 2682 of the lift hook's point portion.

The gate end of the latch 2673 includes a recess defined in a bottom surface thereof, such that at least part of the gate end of the latch 2673, when viewed from a longitudinal cross-section view, takes the shape of a downward facing "C" channel. The point portion of the lift hook 2607 includes a tip section 2682 that has front, top, and back faces that are offset in an inward direction from the rest of the point portion, thus creating a step-transition between a base of lift hook's point portion and its tip section 2682. In this manner, in the presently disclosed embodiment, the tip section of the lift hook's point portion is narrower than the remainder of the point portion. When the latch is in its biased closed position (as illustrated in FIG. 26), the recessed gate end of the latch clamps downward onto and covers the tip section 2682 of the lift hook 2607, such that the tip section 2682 becomes seated within the recess of the latch 2673. In this manner, at least the front, top, and back faces of the tip section 2682 are covered by the recessed end of the latch 2673. This seating of the tip section 2682 of the lift hook 2607 within the recess of the latch 2673 provides strength and stability to the latch 2673 itself, such that the latch 2673 will be structurally supported at its gate end by the tip section of the lift hook 2607 for any active loads placed on the latch in either of the front or back lateral directions, or in a vertical downward direction.

Thus, at least a portion of any active loads placed on the latch 2673 will be transferred to the point portion of the lift hook 2607, which will help carry and support the active load. Accordingly, the latch 2673 of the present embodiment is capable of supporting active loads placed on its gate end by a sling lift loop 2621 in all directions except an upward direction, as the upward direction is the direction in which the latch 2673 is opened.

With the latch 2673 clamping onto the tip section of the lift hook, the latch 2673 is configured so that when the latch 2673 is in the closed position, at least the outer front, top, and back faces of the latch 2673 are in alignment with the non-offset front, top, and back faces of the lift hook. The closed latch 2673 and lift hook 2607 thus provide substantially continuous aligned outer surfaces from the lift hook 2607 onto the latch 2673, or vice versa. In addition, the downward curvature of the top surface of the latch 2673 matches the curvature of the top surface of the cross bar 2604. Accordingly, when the latch 2673 is in a closed position, the curvature prevents a lift loop 2621 being pulled in a downward direction from remaining on either the cross bar 2604 or the latch 2673, as the lift loop 2621 will slip off of the cross bar 2604 before any load is actually lifted by the sling bar 2602. In addition, with the latch 2673 clamping down on and covering the tip section of the lift hook, any risk of impalement on the lift hook 2607 is eliminated.

As will be understood, in alternate embodiments, the entire length of the point portion of the lift hook 2607 may have offset faces such that the entire point portion of the lift hook 2607 is narrower than the bend portion. In this manner, the latch 2673 will be of sufficient length to fully cover the entire point portion of the lift hook 2607.

In addition, each latch 2673 may optionally include a narrow longitudinal blade 2651 extending downward from a bottom surface of the latch 2673 between the gate end and the hinge point 2653 of the latch 2673. The blade on the latch 2673 is rotationally and slidingly seated within a central slot defined in an end portion of the cross bar 2604. When the latch 2673 is opened and closed, the blade 2651 rotates with the latch 2673 about the hinge point 2653 and slidingly withdraws and enters the central slot in the cross bar 2604. The slot and blade 2651 serve to provide as an alignment guide for the latch 2673 when it is opened and closed, as well as provide further lateral stability and strength to the latch 2673 when lateral loads are placed on the latch 2673 in a front or backward direction. The blade 2651 may transfer some of the load applied to the latch 2673 by a lift loop 2621, in either a front or backward lateral direction, to the cross bar 2004.

The latch 2673 is naturally biased to a closed position. To open the latch 2673, a user 2690 depresses the release end of the latch 2673 in a downward direction. The latch 2673 rotates about its hinge pin, or fulcrum, 2653 like a lever arm. This causes the gate end of the latch 2673 to rotate upward and off of the tip section 2682 of the lift hook's point portion, and causes the narrow blade of the latch 2673 to rotate upward and at least partially withdraw from the central slot in the cross bar 2604. One or more lift loops 121 from a patient sling may then be loaded onto, or unloaded from, the lift hook 2607 at the end of the sling bar 2602. If a lift loop that is hooked onto the lift hook 2607 inadvertently becomes positioned such that it is looped only on the latch 2673, when the sling bar 2602 is raised to lift the active load suspended from the lift loop, the latch 2673 will either support the active load placed on it by the lift loop, or slip off of the latch 2673 and back onto the bend portion of the lift hook. Either way, the latch 2673 is configured not to break or otherwise release the lift loop from the sling bar 2602, which might release or drop the active load.

The lift hook 2607 and latches 2673 of the embodiment depicted in FIGS. 26-28 may be made from the same structural and load bearing material, such as for example, steel, titanium, aluminum, or other metals or metal alloys.

Accordingly, disclosed herein are new sling bars for use with patient lifts. In one embodiment the sling bar 2602 includes a downward curved cross bar 2604 having a top surface contour line, a lift hook 2607 at each end of the cross bar that has a top surface contour line in alignment with the cross bar's contour line, and a pair of retention ears 2612 that flank opposite sides of the lift hook 2607 and prevent inadvertent removal of the lift loops 121 of a patient sling from the lift hook. The retention ears 2612 permit a user to load and unload the lift loops 2621 of a patient sling on the sling bar's lift hooks 2607 with a single hand, and without any moving parts or latches. Another embodiment of the sling bar 2602 includes a downward curved cross bar having a top surface contour line, a lift hook 2607 at each end of the cross bar 2604 that has a top surface contour line in alignment with the cross bar's contour line, and a structural latch 2673 that includes a pair of retention ears 2612, 2614 that flank opposite sides of the lift hook 2607 and prevent inadvertent removal of the lift loops 2621 of a patient sling from the lift hook. The latch 2673 permits easier loading of the lift loops 2621 onto a lift hook 2607 while the retention ears 2612, 2614 permit a user to unload the lift loops 2621 from the sling bar's lift hooks 2607 with a single hand.

In still another embodiment the sling bar 2602 includes a downward curved cross bar having a top surface contour line, a lift hook 2607 at each end of the cross bar 2604 that has a bottom surface contour line in alignment with the cross bar's top contour line, and a structural spring 2615 loaded covered latch 2673 seated just below the bottom side of the lift hook 2607 that prevents inadvertent removal of the sling lift loops 2621 from the lift hook, while at the same time preventing the lift loops 2621 from becoming looped over just the latch 2673. In still another embodiment the sling bar 2602 includes a downward curved cross bar having a top surface contour line, a lift hook 2607 at each end of the cross bar 2604 that has a top surface contour line in alignment with the cross bar's contour line, and a structural spring loaded clamp latch 2673 that clamps onto a tip section of the lift hook 2607 and prevents inadvertent removal of the sling's lift loops 2621 from the lift hook 2607, while having the ability to support active loads on the latch 2673.

Covered Latch

Figure 29:
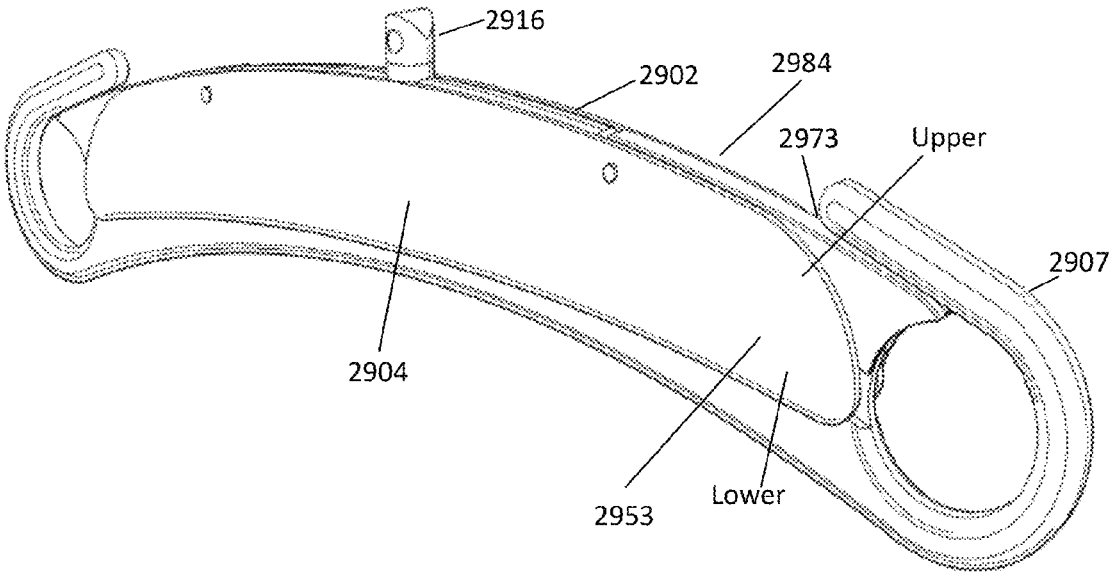
FIG. 29 is an isometric view of a sling bar of an embodiment of the present disclosure, having spring loaded covered latches disposed at each end thereof.
Figure 30:
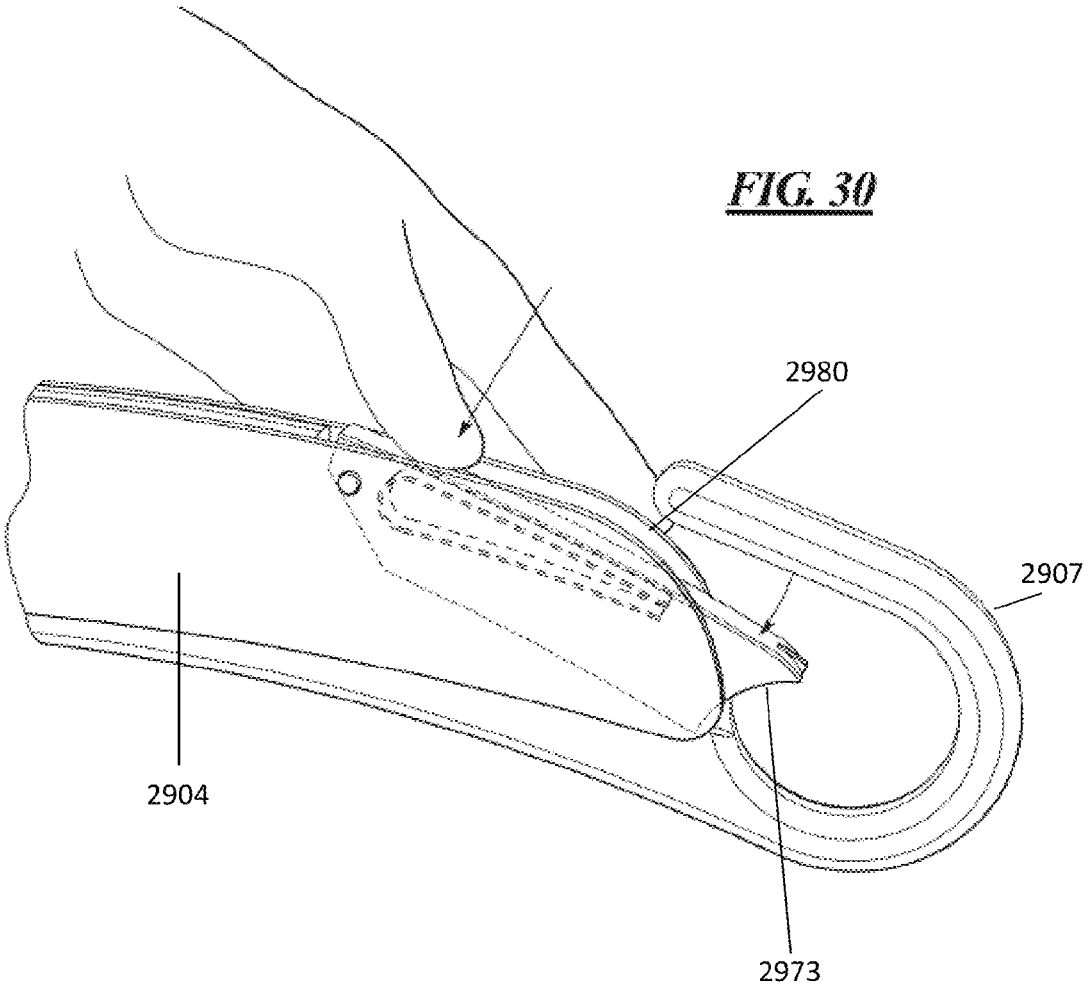
FIG. 30 is a front view of the sling bar of FIG. 29, illustrating the actuation of a spring loaded covered latch at one end of the sling bar.
Figure 31:
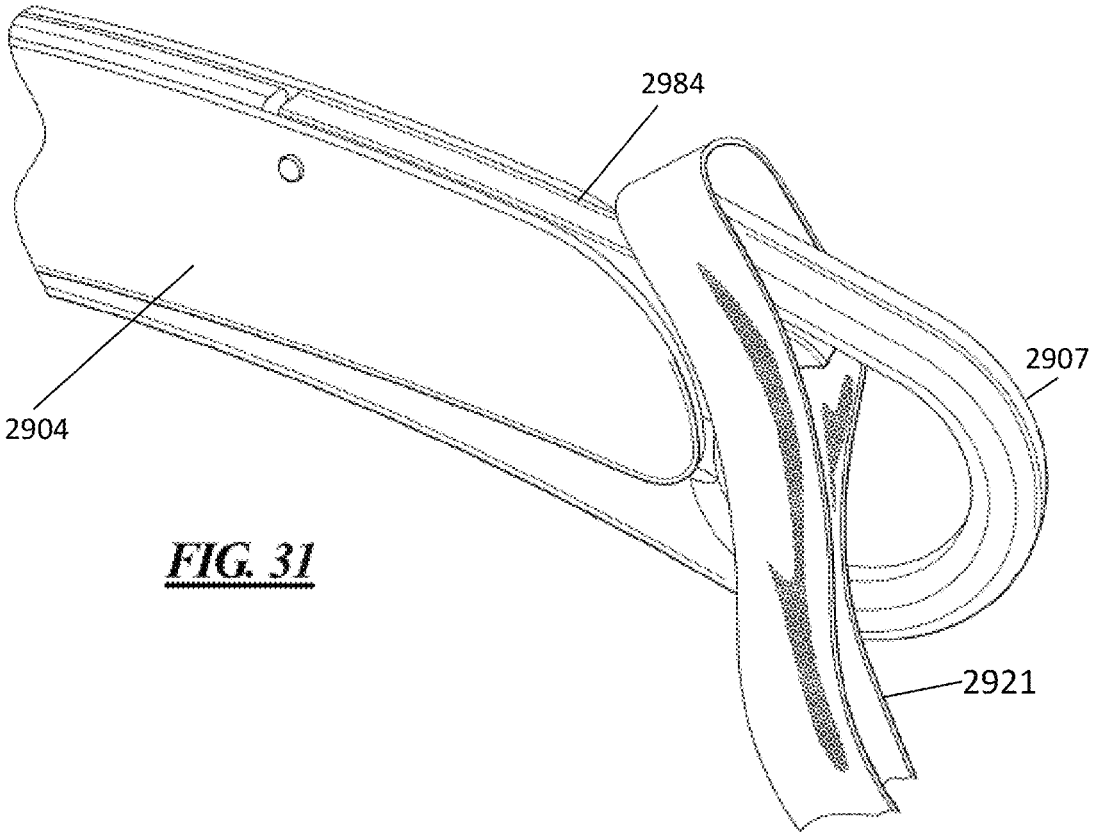
FIG. 31 is a partial isometric view of the sling bar of FIG. 29, illustrating the a lift loop installed and pulling down on just the end of the lift hook and covered latch of the present disclosure, at one end of the sling bar.

Referring to FIGS. 29-31, an alternate embodiment of a new sling bar 2902 is shown, wherein the lift hooks 107 at the ends of the sling bar 2902 include spring loaded covered latches. The latches are covered by the point portion of the lift hook 2907 and are otherwise designed to open whenever a lift load directed vertically downward is place thereon. In such an embodiment, if a lift loop is inadvertently positioned such that it is looped over the top surface of the latch 2973 and the sling bar 2902 is then raised so as to lift an active load in a patient sling there below, the latch 2973 will open and release the lift loop before any load is ever actually lifted from its resting position. In such an embodiment, a sling bar 2902 of the present disclosure may comprise a horizontally positioned downward curved cross bar 2904 having opposite first and second ends, a central lift connector 2916 centered along the length of the cross bar 2904 for connecting to either the free hanging end of an overhead lift strap or a lift arm of a portable lift system, a lift hook 2907 extending longitudinally outward from each end of the cross bar 2904, and a covered latch 2973 hingedly connected to the cross bar 2904 that closes the hook opening between the blunt end point of the lift hook 2907 and the cross bar 2904.

In the embodiment depicted in FIGS. 29-31, the lift hook 2907 includes a shank portion extending from the end of the cross bar 2904. The shank portion is divided into two sections; an upper and a lower section. The upper section of the shank is thinner than the lower section of the shank portion, such that a stepped front and back surface is created with the step separating the lower and upper sections. In alternate embodiments, the ends of the cross bar 2904, as opposed to the shank portion of the lift hook, may comprise the stepped front and back surfaces separating the lower from the upper sections at the ends of the cross bar 2904.

As in many of the above disclosed embodiments, the lift hooks 2907 extend outward from the ends of the cross bar 2904 before curving upward and back toward the ends of the cross bar 2904. At least a percentage of the point portion of the lift hook 2907 extends over the thinned upper section of the shank portion of the lift hook. A bottom surface of the point portion of the lift hook 2907 is generally located immediately above the contour line for the cross bar's top surface. The point portion and shank portion of the lift hook 2907 together define a hook opening between the blunt end point of the lift hook 2907 and the shank portion of the lift hook.

A longitudinal spring loaded latch 2973 is hingedly attached to either the shank portion of the lift hook 2907 or the end portion of the cross bar 2904, and is otherwise disposed between the thinned upper section of the shank and the bottom surface of the point portion of the lift hook 2907. The spring loaded latch 2973 serves to close off the hook opening and prevent the inadvertent removal of a patient sling lift loop from the lift hook 2907 of the sling bar 2902. The spring loaded latch has a longitudinal cross-sectional shape of an upside down square "C" channel, wherein the underside of the latch includes a longitudinal through-channel extending from the hinged end through the latch end of the spring loaded latch 2973. The purpose of the channel 2980 in the underside of the latch is to permit the thinned upper section of the shank to enter the channel in the latch 2973 when the spring loaded latch 2973 is depressed downward towards the shank portion of the lift hook 2907. In this manner, the thinned portion of the shank serves to keep the latch 2973 centered thereon and at the same time provide lateral strength to the latch 2973 itself.

The latch 2973 includes a spring disposed between the latch 2973 and the shank portion of the lift hook. The spring 2973 biases the latch in an upward direction such that a portion of the latch's 2973 top surface at a gate end of the latch 2973 is hingedly rotated to rest against the bottom side of the point portion of the lift hook 2907. In its upward biased position, the gate end of the latch 2973 closes the hook opening that is otherwise present between the shank and point portion of the lift hook 2907. In this manner, the latch 2973 is a covered latch 2973, as the gate end of the latch 2973 is covered by the point portion of the lift hook 2907.

Optionally, a front and back cover may be affixed over the respective front and back sides of the shank portions of each lift hook 2907 and each end portion of the cross bar 2904, so as to hide the interface of the spring loaded latch 2973 with the shank of the lift hook 2907.

The distance between the top surface of the point portion of the lift hook 2907 and the contour line for the top surface of the cross bar 2904 is configured to be as small as possible in this embodiment, so as to significantly reduce the risk of impalement from the point portion of the lift hook 2907 as compared to existing lift hook 2907 designs whose point portion protrude away from the cross bar 2904. The gate end of the latch 2973 may extend approximately half way along the bottom side of the point portion of the lift hook 2907. In this manner, there is a significant overlap between the gate end of the latch 2973 and the point portion of the lift hook 2907, as well as a large distance between the hook opening and the gate end of the latch 2973, both of which helps to reduce any risk of unintentional removal of a lift loop 2921 from the lift hook 2907. Furthermore, the point portion of the lift hook 2907 also includes a curved top surface that is similar to the shape of the cross bar's 2904 top surface contour line. The similar curved shape helps reduce the risk that a sling's lift loop 2921 could unintentionally be place on the outside of the lift hook, because applying any tension to a lift loop placed in such a manner would cause the lift loop 2921 to slide off of the outer surface of the lift hook 2907.

In addition, because of the configuration of the spring loaded latch 2973, a small amount of downward force applied to the gate end 2984 of the latch 2973 will cause the latch to open, permitting lift loops 121 to be easily removed from, or added to, the lift hook 2907. Accordingly, referring to FIG. 31, because of the smooth and rounded outer surfaces of the lift hook 2907, if a sling lift loop 2921 is installed on a lift hook 2907 and becomes wrapped over just the blunt rounded end point of the lift hook 2907, any tension applied to the lift loop 2907 will cause the lift loop 2907 to slip off of the blunt end point and onto the gate end of the latch 2973. Then, because the gate end of the latch can be opened by applying a small downward force thereto, the tension on the lift loop would cause the gate end 2984 of the latch to rotate to an open position and the lift loop 2921 would slide fully out of engagement from the lift hook 2907 and the sling bar 2902.

The latch may be made from the same or alternate material as the lift hook, including steel, aluminum, or any other metal allow capable of supporting the lift loads to which the sling bar 2902 will be subjected. Alternatively, the latch may be made of nylon or other suitable polymers as desired.

Pull Clamp Latch

Referring to FIGS. 32-35, an alternate embodiment of a new sling bar 3202 is shown. The sling bar 3202 of FIG. 32 may comprise a horizontally positioned downward curved cross bar 3204 having opposite first and second ends, a central lift connector 3216 centered along the length of the cross bar 3204 for connecting to either the free hanging end of an overhead lift strap or a lift arm of a portable lift system, a lift hook 3207 extending longitudinally outward from each end of the cross bar 3204, and a spring loaded latch 3273 that is connected to the cross bar 3204 via a hinge 3253. The spring loaded latch 3273 is biased to clamp downward onto a tip section 3282 of the lift hook's point portion and close off the hook opening defined between the end point of the lift hook 3207 and either the cross bar 3204 or the shank portion 3250 of the lift hook 3207.

The spring loaded latch 3273 disposed at each end of the cross bar 3204 is configured as a clamp that is lifted by pulling the latch 3273 in an upward direction about the hinge 3253. Each hinge 3253 (i.e., pivot point) of the latch 3273 is located at a corresponding end of the sling bar 3202, prior to the lift hook 3207 portion, and close to the top surface of the cross bar 3204. The latch 3273 is generally positioned adjacent the end of the cross bar 3204 and is coupled to one or more pull springs 3215*a* and/or 3215*b* configured to bias the latch in a closed position in default. The pull springs 3215*a*, 3215*b* are positioned substantially horizontal with respect to the cross bar 3204 and are located inside the shank portion 3250, on the opposite side of the lift hook 107 with respect to its hinge point 3253.

Figure 34:
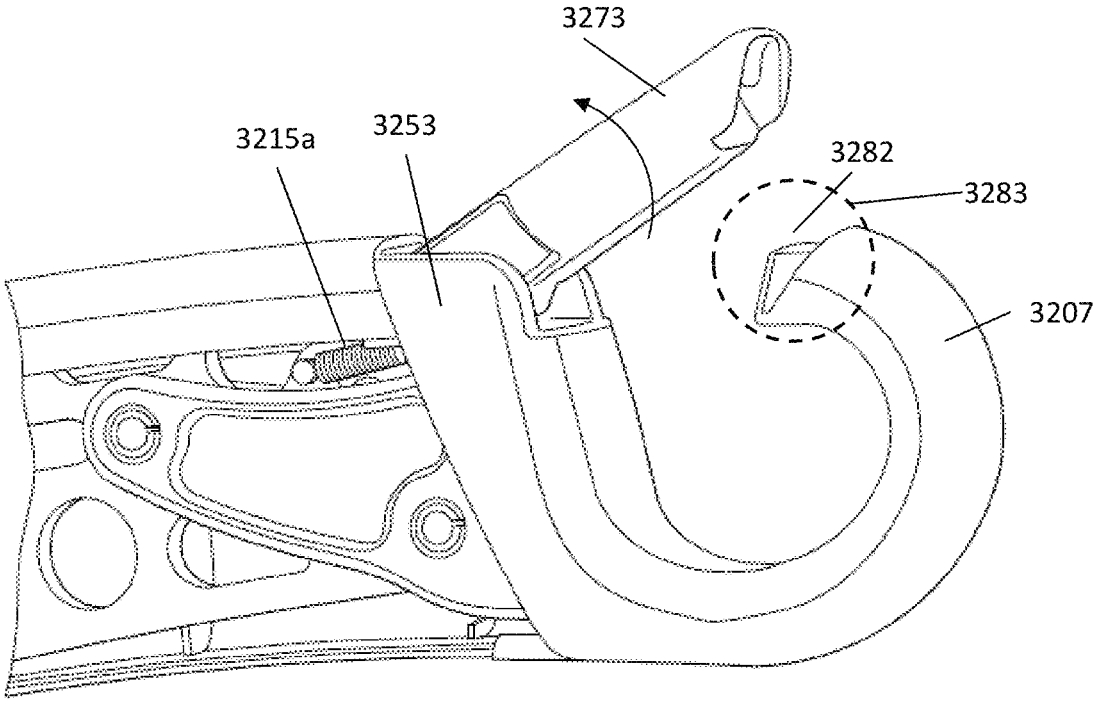
FIG. 34 is a partial front view of the sling bar of FIG. 32, illustrating the actuation of a spring loaded clamp latch at one end of the sling bar.
Figure 35:
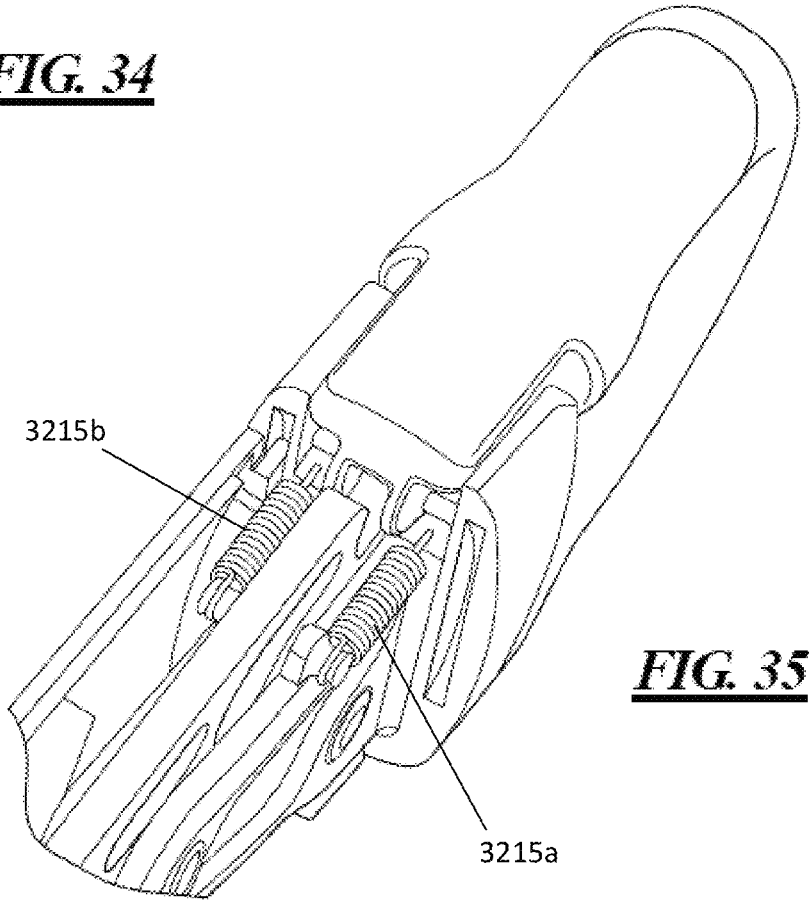
FIG. 35 is an angled top view of sling bar of FIG. 32, illustrating the actuation of a dual spring loaded clamp latch at one end of the sling bar.

As illustrated in FIGS. 34 and 35, the spring 3215*a*/b can be a single or dual pull spring. Alternatively, it may be any type of spring that elastically resists expansion or deflection forces that may bias the latch 3273 in an upward direction. When no outside forces other than the pull spring(s) 3215*a*/b are acting on the latch 3273, the latch 3273 is biased to a closed, downward clamped position over the tip section 3282 of the lift hook's point portion 3283.

The latch 3273 is released by a user pulling the latch 3273 (providing a force) in an upward direction, thereby rotating the latch 3273 about the hinge 3253 and stretching one or more pull springs 3215*a*/b.

Figure 32:
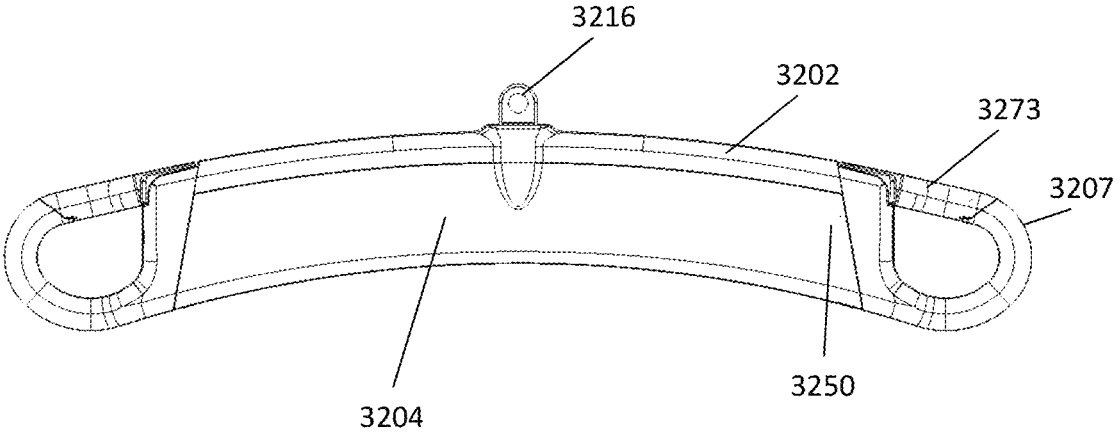
FIG. 32 is an isometric view of a sling bar of another embodiment of the present disclosure, having spring loaded latches.
Figure 33:
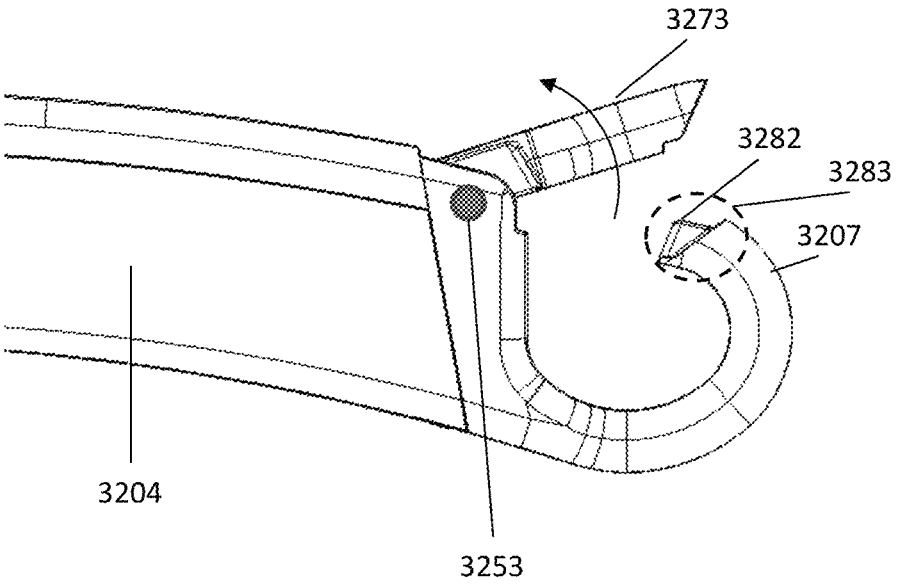
FIG. 33 is a partial front view of the sling bar of FIG. 32, illustrating a lifted clamp latch at one end of the sling bar.

The point portion 3283 of the lift hook 3207 includes a tip section 3282 that has front, top, and back faces that are offset in an inward direction from the rest of the point portion 3283, thus creating a transition between a base of lift hook's point portion 3283 and its tip section 3282. Accordingly, the tip section 3282 of the lift hook's point portion 3283 is narrower than the remainder of the point portion 3283. When the latch is in its biased closed position (as illustrated in FIGS. 32 and 35), the latch clamps downward onto and covers the tip section 3282 of the lift hook 3207, such that the tip section 3282 becomes seated within the recess of the latch 3273. Thus, at least the front, top, and back faces of the tip section 3282 are covered by the recessed end of the latch 3273. This seating of the tip section 3282 of the lift hook 3207 within the recess of the latch 3273 provides strength and stability to the latch 3273 itself, such that the latch 3273 is structurally supported by the tip section 3282 of the lift hook 3207 for any active loads placed on the latch in either of the front or back lateral directions, or in a vertical downward direction.

Thus, at least a portion of any active loads placed on the latch 3273 will be transferred to the point portion of the lift hook 3207, which will help carry and support the active load. Accordingly, the latch 3273 of the present embodiment is capable of supporting active loads placed on its gate end by a sling lift loop in all directions except an upward direction, as the upward direction is the direction in which the latch 3273 is opened.

With the latch 3273 clamping onto the tip section 3282 of the lift hook 3207, the latch 3273 is configured so that when the latch 3273 is in the closed position, at least the outer front, top, and back faces of the latch 3273 are in alignment with the non-offset front, top, and back faces of the lift hook 3207. The closed latch 3273 and lift hook 3207 thus provide substantially continuous aligned outer surfaces from the lift hook 2607 onto the latch 3273, or vice versa.

In one example, the downward curvature of the top surface of the latch 3273 matches the curvature of the top surface of the cross bar 3204. Accordingly, when the latch 3273 is in a closed position, the curvature prevents a lift loop 2621 being pulled in a downward direction from remaining on either the cross bar 3204 or the latch 3273, as the lift loop will slip off of the cross bar 3204 before any load is actually lifted by the sling bar 3202. In addition, with the latch 3273 clamping down on and covering the tip section 3282 of the lift hook 3207, risk of impalement on the lift hook 2607 is substantially reduced.

The lift hook 3207 and latches 3273 of the embodiment(s) depicted in FIGS. 32 to 35 may be made from the same or alternate material as the lift hook, including steel, aluminum, or any other metal allow capable of supporting the lift loads to which the sling bar 3202 will be subjected. Alternatively, the latch 3273 may be made of nylon or other suitable polymers as desired.

What is claimed is:

1. A sling bar for use with an overhead lift system to lift a load suspended in a lift sling there below, comprising:

a cross bar having a center portion and first and second opposite ends, and including a notch in a top surface of the cross bar between the center portion and at least one of the first and second ends;

a pair of lift loop retention ears extending from the at least one of the first and second ends of the cross bar, the pair of ears including a first ear in the pair of retention ears disposed on a first face of the cross bar and a second ear in the pair of retention ears disposed on a second face opposite the first face of the cross bar, the pair of retention ears defining a space there between, wherein the notch is configured to provide access to the space defined by the pair of loop retentions ears associated with the at least one of the first and second ends; and a lift hook disposed at the at least one of the first and second ends of the cross bar in the space defined between the pair of retention ears.

2. The sling bar of claim 1, wherein the cross bar is a rigid beam that is curved such that the first and second ends are offset from the center portion of the cross bar in a vertical plane.

3. The sling bar of claim 1, further comprising a central lift connector at a longitudinal center of the cross bar such that the center of mass of the cross bar is horizontally centered on the lift connector, wherein:

the lift connector defines a connection point for connecting the sling bar to the overhead lift system, and the lift hooks are below the central lift connector.

4. The sling bar of claim 3, wherein the central lift connector is a swivel connector secured into a vertically oriented hole in the center of the cross bar and configured to rotate in a horizontal plane about a vertical axis through cross bar.

5. The sling bar of claim 1, wherein the lift hooks are made of steel or titanium.

6. The sling bar of claim 1, wherein the lift hooks are integrally formed with the cross bar and ears.

7. The sling bar of claim 1, wherein:

the opposite ends of the cross bar are stepped-down; and the cross bar has longitudinal protrusion at a top surface.

8. The sling bar of claim 1, wherein the notch extends through a front and back surface of the cross bar.

9. The sling bar of claim 8, wherein the at least one of the first and second ends includes a longitudinally directed slot or groove that is on the top surface of the cross bar and extends from the notch through the at least one of the first and second ends.

10. The sling bar of claim 1, wherein:

the lift loop retention ears are included in a spring loaded latch piece that is affixed via a hinge to the at least one of the first and second ends; and the spring loaded latch piece is configured to withstand side loads placed thereon.

11. The sling bar of claim 10, wherein the spring loaded latch is biased to extend longitudinally outward from the at least one of the first and second ends and configured to be deflected about the hinge in a downward direction.

12. A sling bar for use with an overhead lift system to lift a load suspended in a lift sling there below, comprising:

a downward curved cross bar having first and second opposite ends;

a central lift connector centered along a length of the cross bar and configured to couple with the overhead lift system;

a lift hook disposed at one of the first and second ends of the cross bar; and a spring loaded latch hingedly connected at the one of the first and second ends of the cross bar, wherein the spring loaded latch is biased to clamp downward onto a tip section of a point portion of the lift hook and close off a hook opening defined between the point portion of the lift hook and either the cross bar or a shank portion of the lift hook.

13. The sling bar of claim 12, wherein the spring loaded latch is configured as a spring-biased lever having a hinged connection to either the shank of the lift hook or the cross bar.

14. The sling bar of claim 12, wherein a fulcrum of the spring loaded latch is located at a point between a spring-biased release end of the spring loaded latch and a gate end of the spring loaded latch.

15. The sling bar of claim 14, wherein the tip section includes front, top, and back faces that are offset in an inward direction from the remainder of the point portion, creating a step-transition between a base of the point portion and the tip section.

16. The sling bar of claim 15, wherein the gate end of the spring loaded latch is biased to a closed, downward clamped position over the tip section of the lift hook.

17. The sling bar of claim 15, wherein the tip section of the point portion is narrower than the remainder of the point portion.

18. The sling bar of claim 15, wherein the gate end of the spring loaded latch is recessed and configured to clamp downward onto and cover the tip section of the lift hook such that the tip section becomes seated within the recess of the spring loaded latch.

19. The sling bar of claim 15, wherein the spring loaded latch comprises a front, top, and back face that are in alignment with the front, top, and back faces of the lift hook.

20. The sling bar of claim 15, wherein the point portion of the lift hook includes offset faces such that the entire-point portion of the lift hook is narrower than the remainder of lift hook.

21. The sling bar of claim 15, wherein the spring loaded latch further comprises a blade that is rotationally and slidingly seated within a central slot defined in an end portion of the cross bar.

22. The sling bar of claim 21, wherein the blade is configured to rotate with the spring loaded latch about the fulcrum and slidingly withdraw and enter the central slot.

23. The sling bar of claim 14, wherein a release end of the spring loaded latch is adjacent to the end of the cross bar and includes one of (i) a compression spring or (ii) a leaf spring disposed between a bottom surface of the spring loaded latch and a top surface of either the shank portion of the lift hook or an upper surface of the one of the first and second ends of the cross bar.

24. The sling bar of claim 23, wherein the spring loaded latch is configured to elastically resists compression and deflection forces, and bias the release end of the spring loaded latch in an upward direction and the gate end of the spring loaded latch in a downward direction.

25. A sling bar for use with an overhead lift system to lift a load suspended in a lift sling there below, comprising:

a downward curved cross bar having first and second opposite ends;

a central lift connector centered along a length of the cross bar and configured to couple with the overhead lift system;

a lift hook disposed at one of the first and second ends of the cross bar; and a longitudinal spring loaded latch hingedly connected at the one of first and second ends of the cross bar, wherein the spring loaded latch is biased to clamp in an upward direction such that a portion of a top surface at a gate end of the spring loaded latch is hingedly rotated and biased against a bottom side of a point portion of the lift hook.

* * * * *